US011189977B2

(12) United States Patent
Sparrowhawk et al.

(10) Patent No.: US 11,189,977 B2
(45) Date of Patent: Nov. 30, 2021

(54) EDGE-COUPLED DIFFERENTIAL STRIPLINE CONNECTOR

(71) Applicant: Leviton Manufacturing Co., Inc., Melville, NY (US)

(72) Inventors: Bryan L. Sparrowhawk, Monroe, WA (US); Bret Taylor, Seattle, WA (US)

(73) Assignee: Leviton Manufacturing Co., Inc., Melville, NY (US)

( * ) Notice: Subject to any disclaimer, the term of this patent is extended or adjusted under 35 U.S.C. 154(b) by 179 days.

(21) Appl. No.: 16/655,804

(22) Filed: Oct. 17, 2019

(65) Prior Publication Data

US 2020/0153176 A1 May 14, 2020

Related U.S. Application Data

(60) Provisional application No. 62/767,126, filed on Nov. 14, 2018.

(51) Int. Cl.
*H01R 24/84* (2011.01)
*H01R 13/28* (2006.01)
(Continued)

(52) U.S. Cl.
CPC ..... *H01R 24/84* (2013.01); *H01R 4/48* (2013.01); *H01R 13/28* (2013.01); *H01R 13/502* (2013.01); *H01R 13/64* (2013.01)

(58) Field of Classification Search
CPC ..... H01R 13/24; H01R 13/26; H01R 13/28; H01R 13/33; H01R 13/436; H01R 13/502;
(Continued)

(56) References Cited

U.S. PATENT DOCUMENTS 3,594,695 A * 7/1971 Wofford ..... H01R 13/28 439/157
4,737,118 A * 4/1988 Lockard ..... H01R 12/68 439/295
(Continued)

OTHER PUBLICATIONS

IRISO "Guaranteed Connection: Increases the chances of proper contact by cleaning and adding a redundant two-point-contact" Technical Paper. IRISO Electronics Co., Ltd, Copyright 2019.

*Primary Examiner* — Edwin A. Leon
*Assistant Examiner* — Milagros Jeancharles
(74) *Attorney, Agent, or Firm* — Amin, Turocy & Watson, LLP

(57) ABSTRACT

A hermaphroditic connector for use in single or multiple twisted-pair connectivity applications is constructed using a small number of parts having a simple but durable assembly. The connector housing comprises an elongated form factor that, when mated with a similar hermaphroditic connector, forms a rigid overlapping shield around the electrical contacts of the two connectors. While unmated, the conductive tines within the connector have a default curved profile that facilitates reliable connectivity with tines of a mating connector. When the connector is mated with a similar connector, the tines are deformed to a flatter profile by support plates within the connectors, yielding a shape more conducive to high-frequency signal applications. The shape of the tines also yields multiple in-line redundant contact points to ensure reliable connectivity without adding to the width of the connector.

20 Claims, 18 Drawing Sheets

(51) Int. Cl.
*H01R 13/502* (2006.01)
*H01R 13/64* (2006.01)
*H01R 4/48* (2006.01)

(58) Field of Classification Search
CPC .. H01R 13/506; H01R 13/635; H01R 13/642; H01R 13/2492; H01R 28/84; H01R 28/86; H01R 4/48; H01R 12/71
See application file for complete search history.

(56) References Cited

U.S. PATENT DOCUMENTS

| | | | | |
|---|---|---|---|---|
| 5,098,311 | A * | 3/1992 | Roath | H01R 12/714 439/290 |
| 5,857,867 | A * | 1/1999 | Henry | H01R 13/28 439/290 |
| 6,881,084 | B2 * | 4/2005 | Crossan | G02B 6/383 439/284 |
| 9,437,961 | B1 * | 9/2016 | Smajda | H01R 13/5219 |
| 9,634,417 | B2 * | 4/2017 | Ramanna | H01R 13/28 |
| 2012/0142223 | A1 | 6/2012 | Ogura et al. | |
| 2012/0142226 | A1 | 6/2012 | Funayama et al. | |
| 2014/0295681 | A1 * | 10/2014 | Miyaki | H01R 24/84 439/65 |
| 2015/0079829 | A1 * | 3/2015 | Brodsgaard | H01R 24/84 439/284 |
| 2018/0198227 | A1 * | 7/2018 | Mundt | H01R 24/84 |
| 2018/0301842 | A1 * | 10/2018 | Somanathapura Ramanna | H01R 24/84 |

* cited by examiner

EDGE-COUPLED DIFFERENTIAL STRIPLINE CONNECTOR

CROSS-REFERENCE TO RELATED APPLICATIONS

This application claims priority to U.S. Provisional Patent Application No. 62/767,126, filed on Nov. 14, 2018, and entitled "EDGE-COUPLED DIFFERENTIAL STRIPLINE CONNECTOR," the entirety of which is hereby incorporated herein by reference.

TECHNICAL FIELD

The disclosed subject matter relates generally to electrical connector systems, and in particular to hermaphroditic or genderless connectors for use in data or power connection applications

BACKGROUND

In contrast to common male-female type connector systems, which comprise a male connector and a female connector that engage with one another to establish an electrical connection, hermaphroditic (or genderless) connectors are designed such that two connectors of the same type can engage with one another to establish the connection. Despite their advantages, hermaphroditic connectors are not commonly used within the realm of ethernet-based data connectivity, which more typically relies on cabling infrastructures built on male/female registered jack (RJ) connectors that support four twisted pair channels.

While conventional ethernet protocols have been designed to transmit data packets over four twisted pair channels—necessitating the use of cables having four twisted pair conductors—new ethernet protocols are being developed that leverage a single differential or balanced pair of conductors (e.g., a twisted pair or another differential pair configuration) for packet transmission. As these single-pair ethernet protocols gain in popularity, new cabling and connectivity requirements will be required for both new network installations as well as migration of existing four-pair networks to single-pair protocols.

Moreover, RJ connectors are ill suited for high-frequency signal applications due to the presence of sharp discontinuities or stubs on the electrical contacts, which may act as resonant entities that disturb the characteristic impedance and compromise high-frequency signal integrity by creating signal reflections.

The above-described deficiencies of current connector systems are merely intended to provide an overview of some of the problems of current technology, and are not intended to be exhaustive. Other problems with the state of the art, and corresponding benefits of some of the various non-limiting embodiments described herein, may become further apparent upon review of the following detailed description.

SUMMARY

The following presents a simplified summary of the disclosed subject matter in order to provide a basic understanding of some aspects of the various embodiments. This summary is not an extensive overview of the various embodiments. It is intended neither to identify key or critical elements of the various embodiments nor to delineate the scope of the various embodiments. Its sole purpose is to present some concepts of the disclosure in a streamlined form as a prelude to the more detailed description that is presented later.

Various embodiments described herein provide a hermaphroditic connector suitable for use in single differential pair or multiple differential pair applications. Embodiments of the hermaphroditic connector described herein include structural features that yield a robust connection resistant to bending and pull forces. For example, the connector housing can comprise an inner shell component that, when mated with a corresponding inner shell component of a mating hermaphroditic connector, forms a shield that protects the connection area of the electrical contacts within the connectors. While mated, the connectors are held in place by latching teeth formed on outer shell components of the two connectors, or by other features on the inner shells of the two connectors. The connectors can be disengaged by applying pressure to a release bar on one or both of the outer shell components, causing the outer shell components to displace relative to the inner shell components.

The electrical contacts of the hermaphroditic connector comprise curved tines that rest on a dielectric support plate disposed within the connector housing between the inner and outer shell components. While the connector is disengaged, the tines have a first curved profile having a lead-in shape that facilitates reliable electrical engagement with corresponding tines of a mating connector as the two connectors are being mated. As the two hermaphroditic connectors are plugged together, the tines of the two connectors are pressed between the tine support plates of the two connectors, causing the tines to morph from the first curved profile to a second curved profile that is flattened relative to the first curved profile. By emulating a flat edge-coupled stripline transmission line, this flattened tine shape promotes a high level of signal integrity even in high frequency signal applications.

Moreover, the design of the tines and their interaction with the tine support plates yield multiple in-line redundant points of contact between each tine of a connector and its corresponding tine in a mating connector. Such in-line redundant contact points can yield a connector with a smaller width relative to connectors that rely on bifurcated contact points for contact redundancy. This design minimizes consumption of connector panel area by the connector, which can be beneficial in high-density connectivity environments.

The hermaphroditic connector comprises a relatively small number of component parts that assembly simply, and can therefore be manufactured at low cost. Providing a hermaphroditic connector suitable for differential pair communication (e.g., communication over twisted pairs or other types of balanced or differential pairs) or Power over Ethernet applications allows end users to standardize on a single type of connector for use in such applications, rather than stocking both male and female connectors.

To the accomplishment of the foregoing and related ends, the disclosed subject matter, then, comprises one or more of the features hereinafter more fully described. The following description and the annexed drawings set forth in detail certain illustrative aspects of the subject matter. However, these aspects are indicative of but a few of the various ways in which the principles of the subject matter can be employed. Other aspects, advantages, and novel features of the disclosed subject matter will become apparent from the following detailed description when considered in conjunction with the drawings. It will also be appreciated that the detailed description may include additional or alternative embodiments beyond those described in this summary.

DETAILED DESCRIPTION

Figure 1:
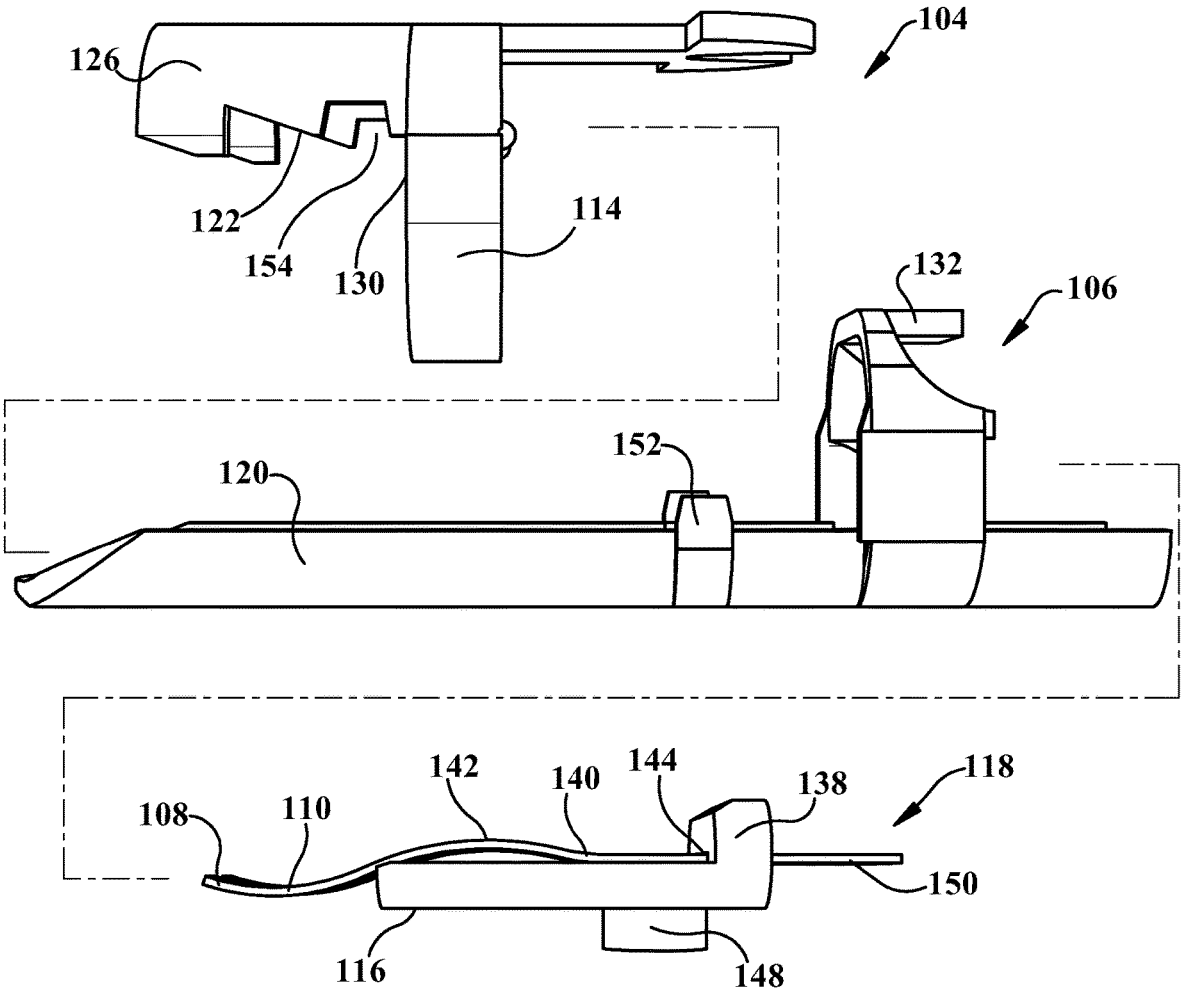
FIG. 1 depicts respective side views of components that make up an example hermaphroditic connector.

The subject disclosure is now described with reference to the drawings wherein like reference numerals are used to refer to like elements throughout. In the following description, for purposes of explanation, numerous specific details are set forth in order to provide a thorough understanding of the subject disclosure. It may be evident, however, that the subject disclosure may be practiced without these specific details. In other instances, well-known structures and devices are shown in block diagram form in order to facilitate describing the subject disclosure.

One or more embodiments described herein provide a hermaphroditic connector suitable for use in single-pair ethernet network architectures or other connectivity applications. The connector is constructed using a simple assembly of a small number of component parts, and can therefore be manufactured inexpensively. While two hermaphroditic connectors are mated, the resulting assembly has a rigid double-layered form designed to resist bending and pull forces, as well as to protect the integrity of the connections between the electrically conductive contacts within the connectors.

While disengaged, the electrical contacts or tines within the connector can conform to a curved profile having a curved lead-in shape that facilitates smooth and reliable electrical engagement with the corresponding tines of a similar mating connector. As two connectors are mated together, the tines of both connectors are deformed to a more flattened shape that, by emulating an edge-coupled stripline, can promote high signal integrity in high frequency signal applications.

Figure 2:
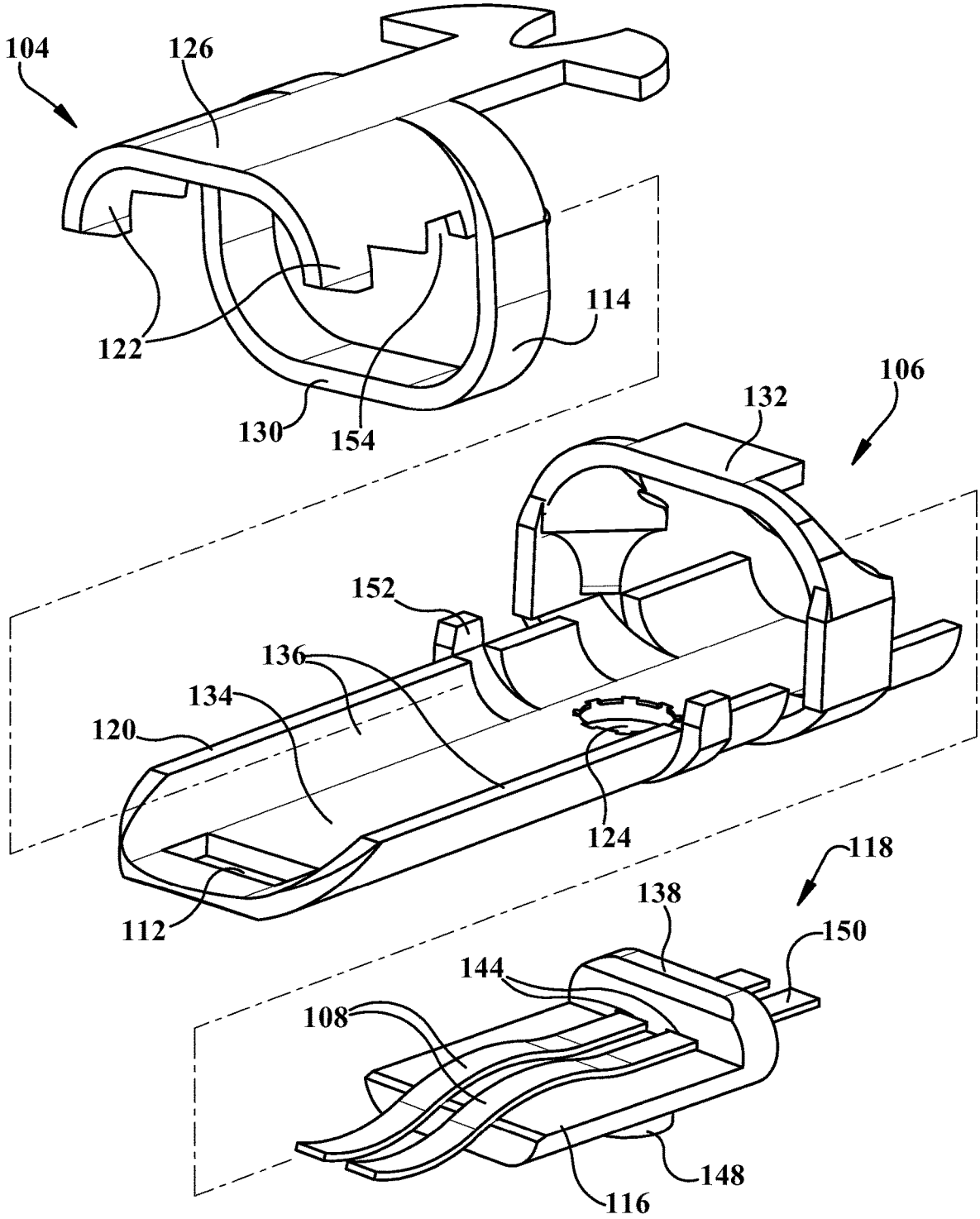
FIG. 2 depicts respective perspective views of the components that make up the example hermaphroditic connector.

FIG. 1 depicts respective side views of components 104, 106, and 118 that make up an example hermaphroditic connector according to one or more embodiments. FIG. 2 depicts respective perspective views of the components 104, 106, and 118. The example hermaphroditic connector comprises an outer shell component 104, an inner shell component 106, and a tine assembly 118.

Outer shell component 104 comprises an outer half-shell segment 126 that protrudes from a looped release bar 114. Release bar 114 comprises a loop having a generally round shape in some embodiments. In the illustrated example, release bar 114 has a rounded rectangular shape (see, e.g., FIG. 2). However, release bar 114 may be of substantially any shape (e.g., circular, oval, square, column, post, etc.) without departing from the scope of one or more embodiments of this disclosure.

Outer half-shell segment 126 extends from a segment of a front edge 130 of the release bar 114. In the illustrated example, outer half-shell segment 126 extends from a segment of the front edge 130 comprising a top horizontal edge and portions of the two adjacent vertical edges of the release bar 114. Thus, the front profile of the outer half-shell segment 126 substantially follows the contour of this segment of the front edge 130 of the release bar 114, yielding a flat top surface and two downward-facing edges.

One or more latching teeth 122 are formed on each of the two downward-facing edges of outer half-shell segment 126. As will be described below, these latching teeth 122 are configured to engage with similar latching teeth 122 formed on a mating connector in order to hold the two connectors in their mated positions. Behind each set of latching teeth 122, a notch 154 is formed and is positioned to engage with a corresponding engagement protrusion 152 on the inner shell component 106. Outer shell component 104 can be made of any suitable material, including but not limited to metal or a rigid or flexible plastic.

Inner shell component 106 comprises an elongated inner half-shell segment 120 that is longer than outer half-shell segment 126 of the outer shell component 104. Similar to the outer shell component 104, inner shell component 106 can be made of metal or of a rigid or flexible plastic. Embodiments in which the inner shell component 106 is made of metal, or is metal-plated, can beneficially provide shielding for the electrical contacts within the connector. Inner half-shell segment 120 comprises a substantially flat bottom surface 134 (see, e.g., FIG. 2) whose two long edges curve upward to form two side walls 136 that run the length of the inner half-shell segment 120 (or a significant portion of the length of the inner half-shell segment 120). An engagement protrusion 152 is formed on each of the two side walls 136 and is configured to engage with the corresponding notch 154 formed on the outer shell component 104.

A multipurpose hole 112 is formed on the bottom surface 134 near the front end of the inner half-shell segment 120 and can be used in conjunction with supplemental latching mechanisms. Multipurpose hole 112 can also be used to facilitate engagement with other types of connectors that are not similar hermaphroditic connectors (e.g., PCB-mounted connectors). In applications in which multipurpose hole 112 is used to latch the connector to its mating connector, the outer shell component 104 may be omitted. Another hole 124 is formed on the bottom surface 134 near the rear end of the inner half-shell segment 120 and is configured to engage with a corresponding attachment stud 148 on the tine support plate 116 of the tine assembly 118. Inner shell component 106 also comprises a loop structure 132 formed near the rear end of the inner shell component 106, which can assist with disengagement of the connector, as will be described below. The tine assembly 118 is configured to reside partially within the loop structure 132 when the components 104, 106, and 118 are assembled into the composite connector.

Tine assembly 118 comprises a tine support plate 116 on which two electrically conductive tines 108 are supported. In some embodiments, tine support plate 116 can be made of a dielectric material. Although only two tines 108 are depicted in the illustrated examples—depicting an embodiment suitable for use in single-pair applications—other embodiments of tine assembly 118 may include more than two tines 108 as space allows, rendering the connector 102 suitable for applications requiring greater numbers of conductors (e.g., multiple twisted pairs). Tines 108 are held in place by a wall 138 that projects substantially perpendicular to the top surface of the tine support plate 116 at or near the rear end of the tine support plate 116. The tines 108 pass through respective openings 144 in the wall 138 such that the contacting segments of the tines 108 (that is, the end segments of the tines 108 that will overlap and engage with corresponding tines of a similar mating connector) are disposed over the top surface of the tine support plate 116. In the illustrated embodiment, the contacting segments of the tines 108 have similar curved profiles. Specifically, as shown in FIG. 1, the profile of each tine 108 begins curving upward at a point 140 near the wall 138, begins curving downward at a point 142 nearer the front end of support plate 116, and begins curving upward again at a point 110 near the front-facing tip of the tine 108, where point 110 is located beyond the front end of support plate 116. This profile causes the tips of the tines 108 to angle upward slightly in a ski-tip fashion. This illustrated curved profile is only intended to be exemplary, and it is to be appreciated that tines 108 may conform to other types of curved profiles, including profiles that include sharp deformations or angular transitions along the contour of the profile, without departing from the scope of this disclosure. An attachment stud 148 protrudes from the bottom of the support plate 116 and is configured to engage with hole 124 in the bottom of inner half-shell segment 120.

Figure 3:
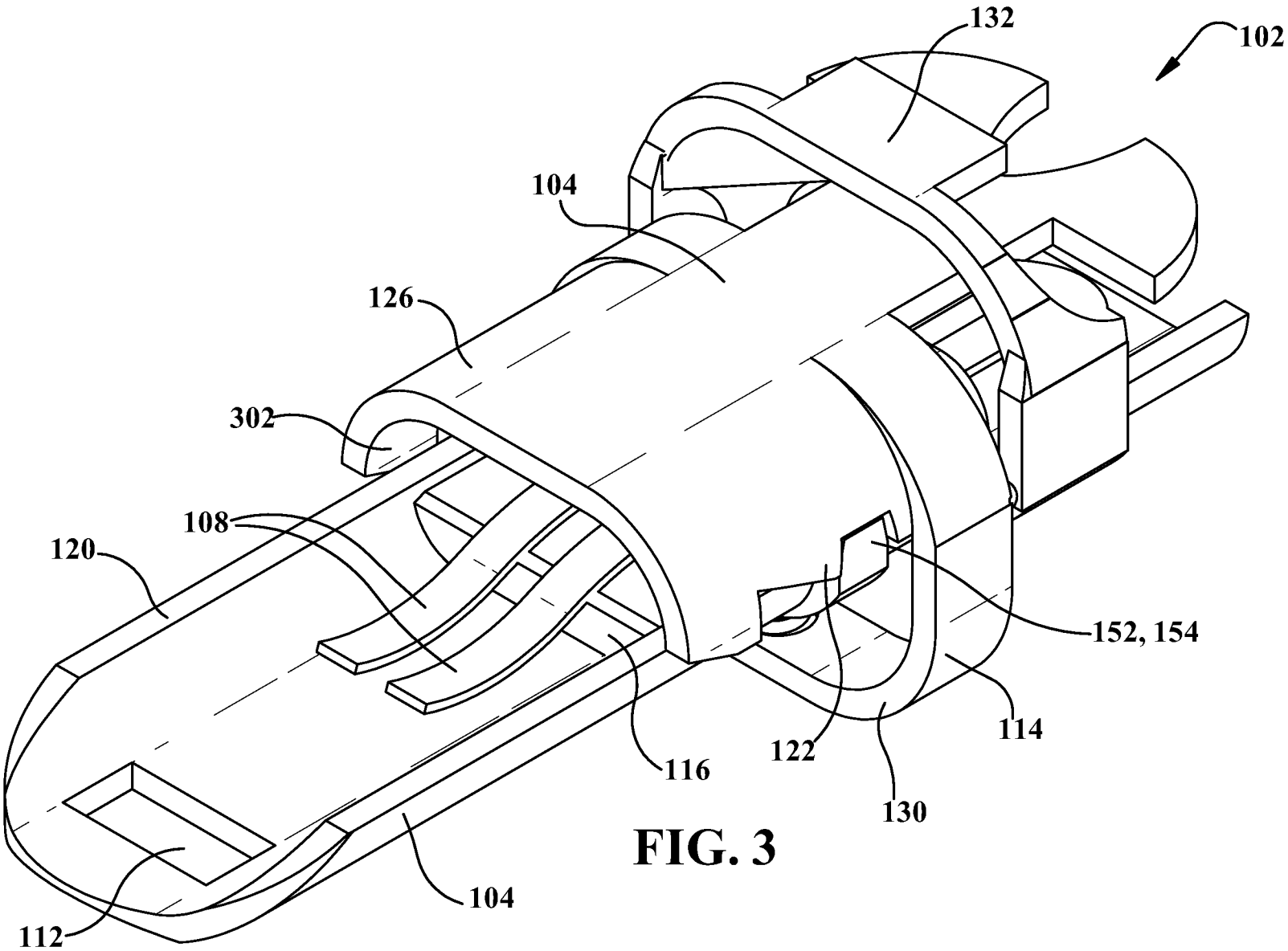
FIG. 3 is a top perspective view of an example hermaphroditic connector.
Figure 4:
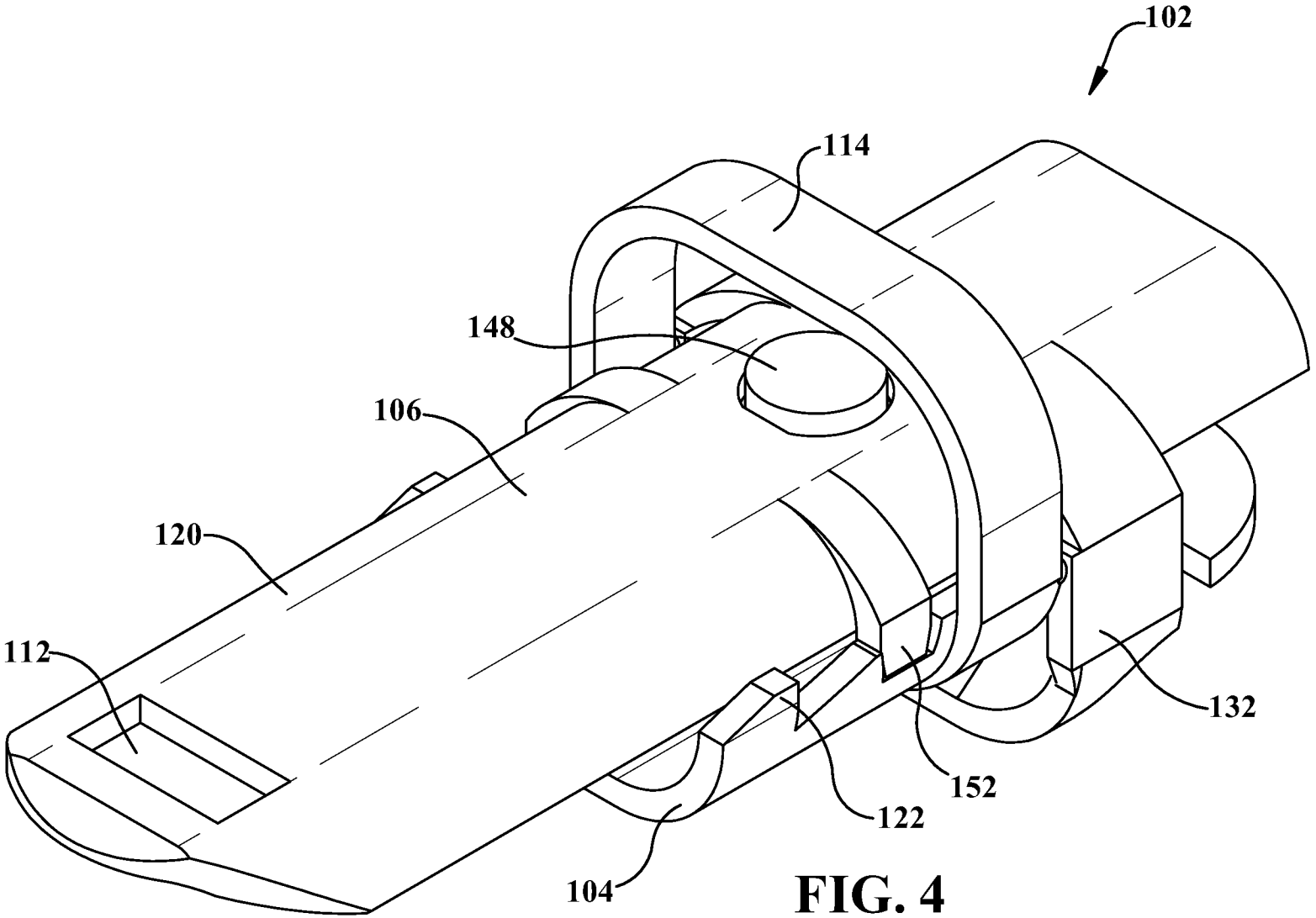
FIG. 4 is a bottom perspective view of the example hermaphroditic connector.
Figure 5:
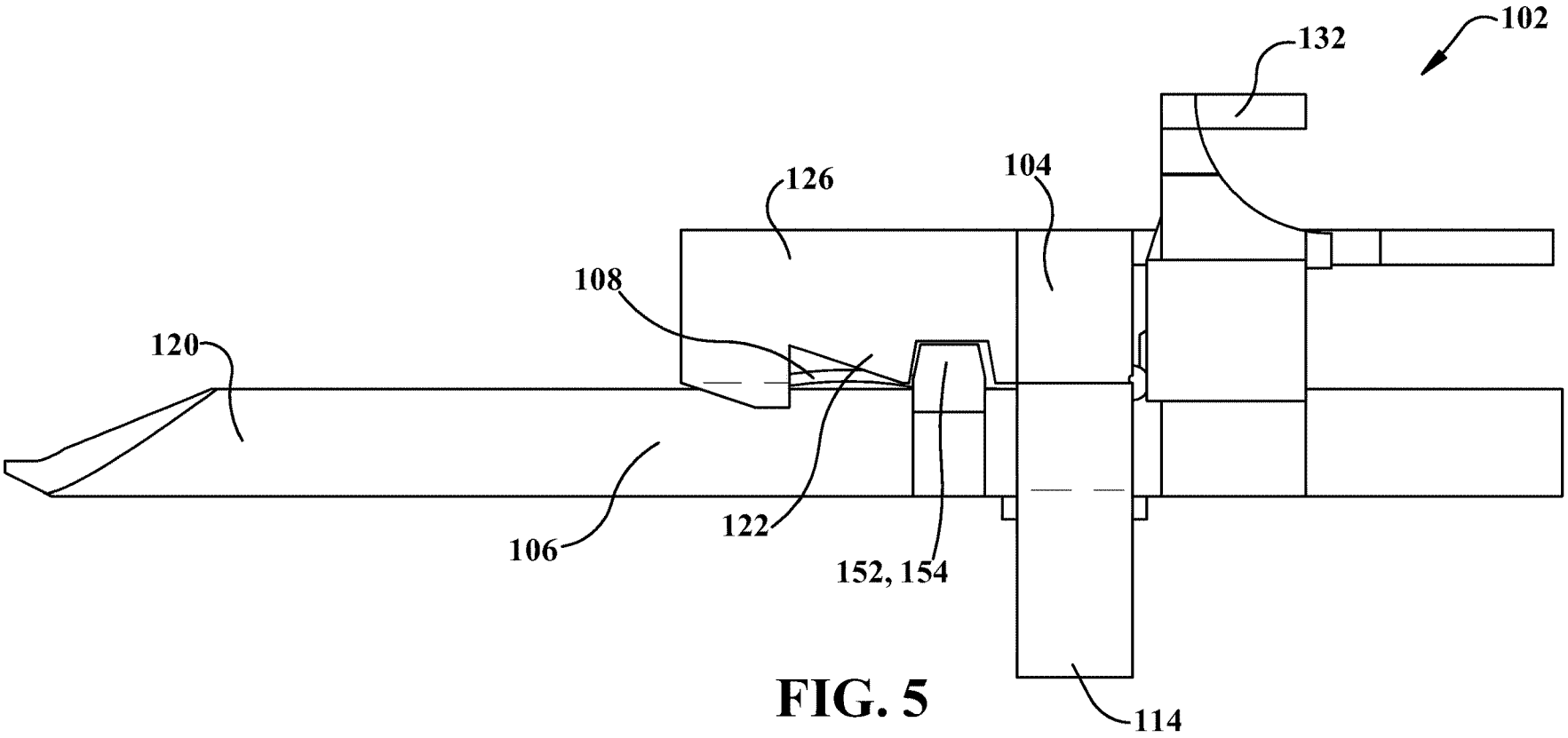
FIG. 5 is a side view of the example hermaphroditic connector.
Figure 6A:
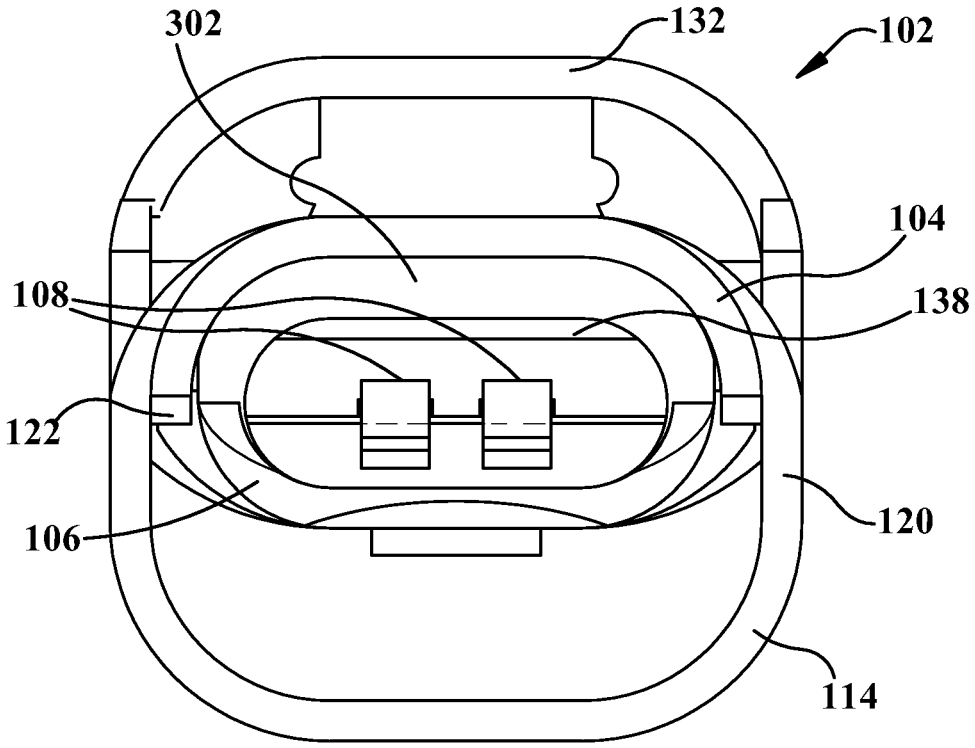
FIG. 6*a* is a front view of the example hermaphroditic connector.
Figure 6B:
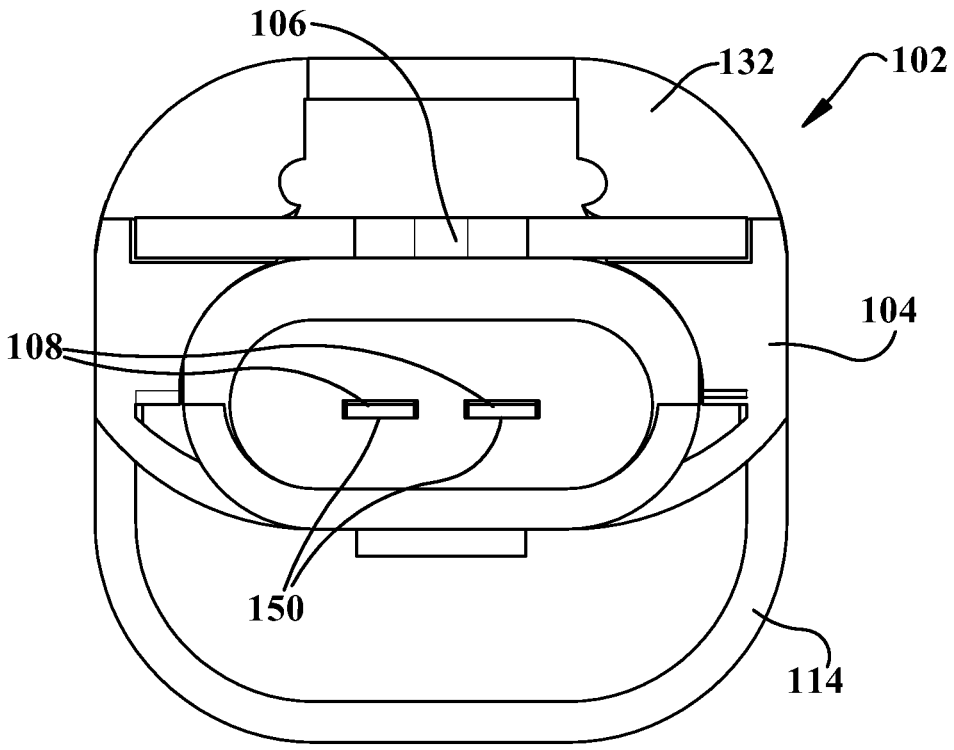
FIG. 6*b* is a rear view of the example hermaphroditic connector.
Figure 7A:
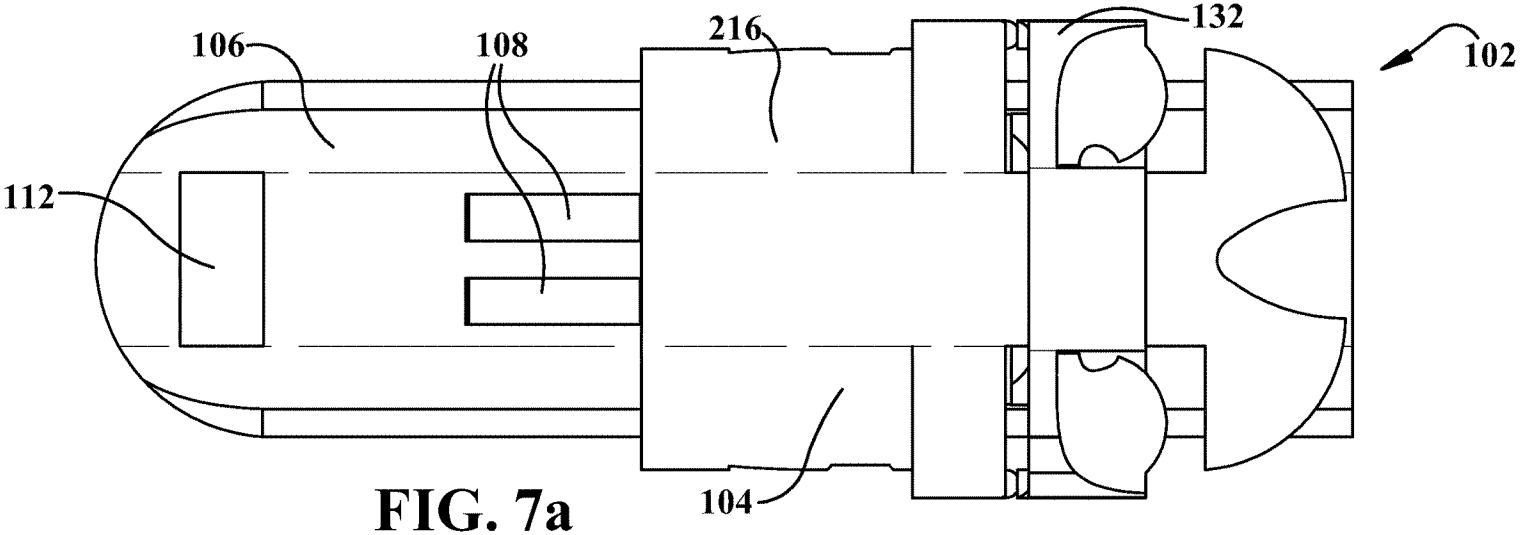
FIG. 7*a* is a top view of the example hermaphroditic connector.
Figure 7B:
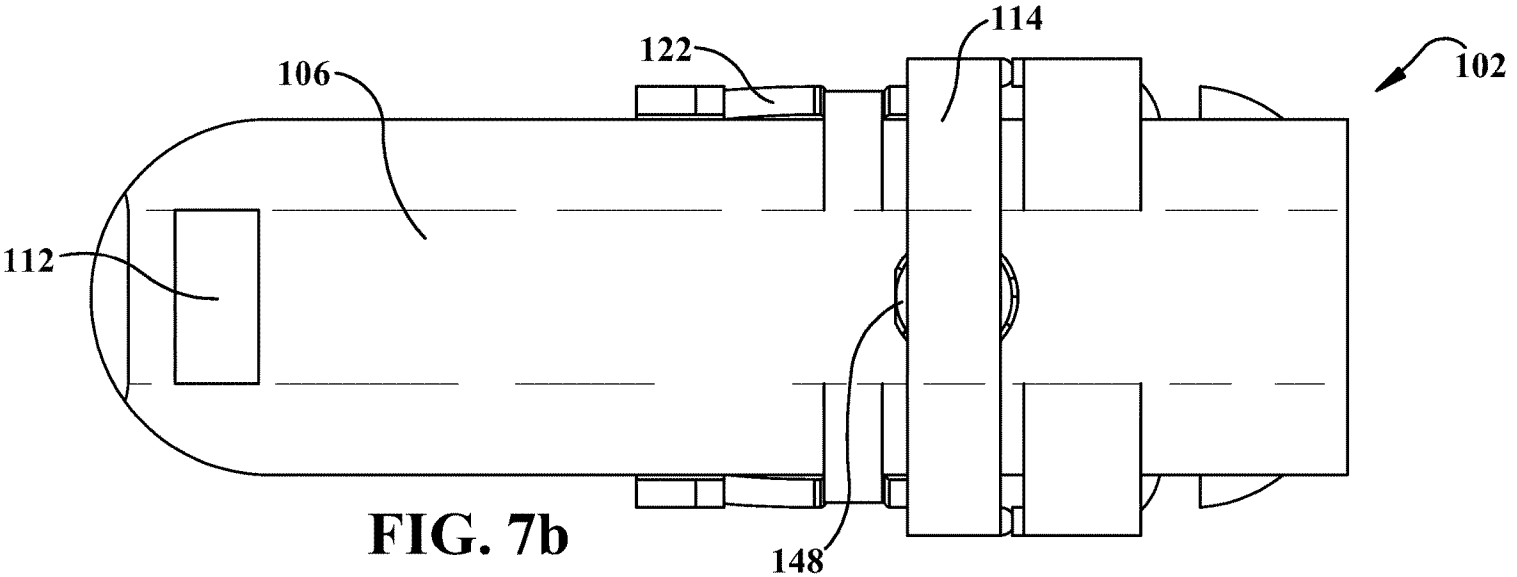
FIG. 7*b* is a bottom view of example hermaphroditic connector.

FIG. 3 is a top perspective view of an example hermaphroditic connector 102 comprising an assembly of components 104, 106, and 118. FIG. 4 is a bottom perspective view of the hermaphroditic connector 102. FIG. 5 is a side view of the hermaphroditic connector 102. FIGS. 6*a* and 6*b* are front and rear views, respectively, of the hermaphroditic connector 102. FIGS. 7*a* and 7*b* are top and bottom views, respectively, of hermaphroditic connector 102. As shown in these views, the tine assembly 118 (comprising tine support plate 116 and tines 108) is anchored to the inner shell component 106 and resides within the inner half-shell segment 120. Attachment stud 148 on the bottom of support plate 116 engages with hole 124 on the inner shell component 106 to facilitate correct placement of the tine assembly 118 within the inner shell component 106. If used, the outer shell component 104 can fit over the tine assembly 118 and is held in place against the inner shell component 106. The outer shell component 104 is oriented relative to the inner shell component 106 such that the open side of the outer half-shell segment 126 faces the open side of the inner half-shell segment 120. When so assembled, the outer half-shell segment 126 of outer shell component 104 and the inner half-shell segment 120 of inner shell component 106 together form a tunnel 302 (see, e.g., FIGS. 3, 6*a*) surrounding the tine support plate 116 and a portion of the contact areas of tines 108 (in some embodiments, the outer half-shell segment 126 may have a length that completely encompasses the contact areas of the tines 108). The rear tips 150 of tines 108 (see, e.g., FIG. 6*b*) project toward the rear of the connector 102 (see, e.g., FIG. 6*b*) to allow electrical connection to conductors of a data cable (e.g., conductors of a twisted pair of an ethernet cable).

Engagement between the protrusion 152 on the inner shell component 106 and the notch 154 on the outer shell component 104 can prevent lateral displacement between the inner and outer shell components. In alternative embodiments, this lateral displacement can be prevented using other means (e.g., by locating release bar 114 behind loop structure 132 to prevent forward displacement).

In some embodiments, outer shell component 104 can be connected to inner shell component 106 using springs (e.g., compression springs, see FIG. 17 discussed below) that hold the outer shell component 104 in place against the inner shell component 106 in a default state, but allow the outer shell component 104 to be displaced upward relative to the inner shell component 106 in response to pressure applied to the release bar 114 to facilitate disengagement from a mating connector. In other embodiments, instead of relying upon a spring to hold the outer shell component 104 in place against the inner shell component 106 when not being displaced, a flexible boot encompassing the connector 102 (to be discussed in more detail below in connection with FIGS. 13-16) can provide the necessary pressure that holds the outer shell component 104 in place while allowing the outer shell component 104 to be displaced when necessary. In either case, the spring and/or the boot can apply spring-loaded pressure to outer shell component 104, holding the outer shell component 104 in the default closed position in the absence of external pressure applied to the release bar 114.

The width of the outer half-shell segment 126 of outer shell component 104 is slightly greater than the width of the inner half-shell segment 120 of inner shell component 106, and the outer shell component 104 and inner shell component 106 are assembled such that the latching teeth 122 overlap slightly with the outer side surfaces of the inner half-shell segment 120 (see, e.g., FIGS. 3, 5, 6*a*, and 7*a*).

Figure 8:
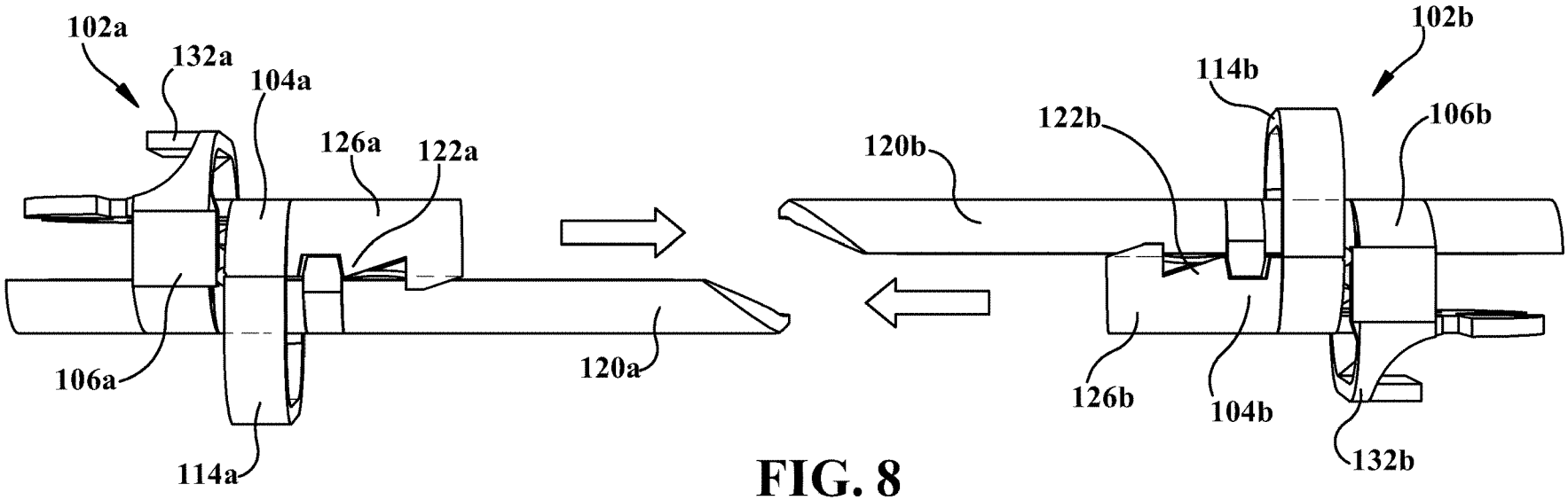
FIG. 8 is a side view depicting two hermaphroditic connectors aligned and oriented for engagement with one another.

FIG. 8 is a side view depicting two hermaphroditic connectors 102*a* and 102*b* aligned and oriented for engagement with one another. Both connectors 102*a* and 102*b* conform to the design described above in connection with FIGS. 1-7*b*. To align the two hermaphroditic connectors 102*a* and 102*b* for connection, connectors 102*a* and 102*b* are positioned with their front ends facing one another and connector 102*b* is rotated about its center axis 180 degrees relative to connector 102*a*, such that connector 102*b* is inverted relative to connector 102*a*. The two connectors 102*a* and 102*b* are then brought together as indicated by the arrows. The slanted front ends of the inner shell components 106 can assist in guiding the connectors 102*a* and 102*b* into proper alignment as the connectors are brought together.

Figure 9:
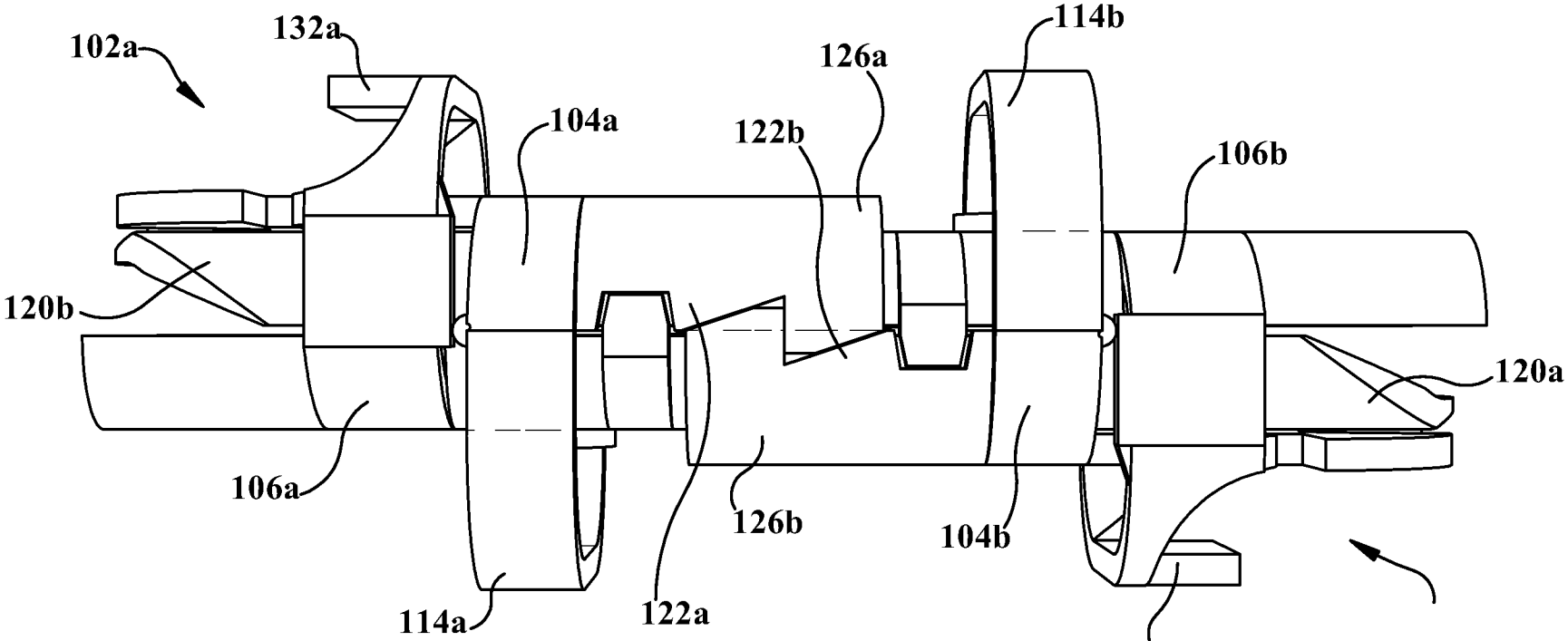
FIG. 9 is a side view of the two hermaphroditic connectors in the fully engaged state.
Figure 10:
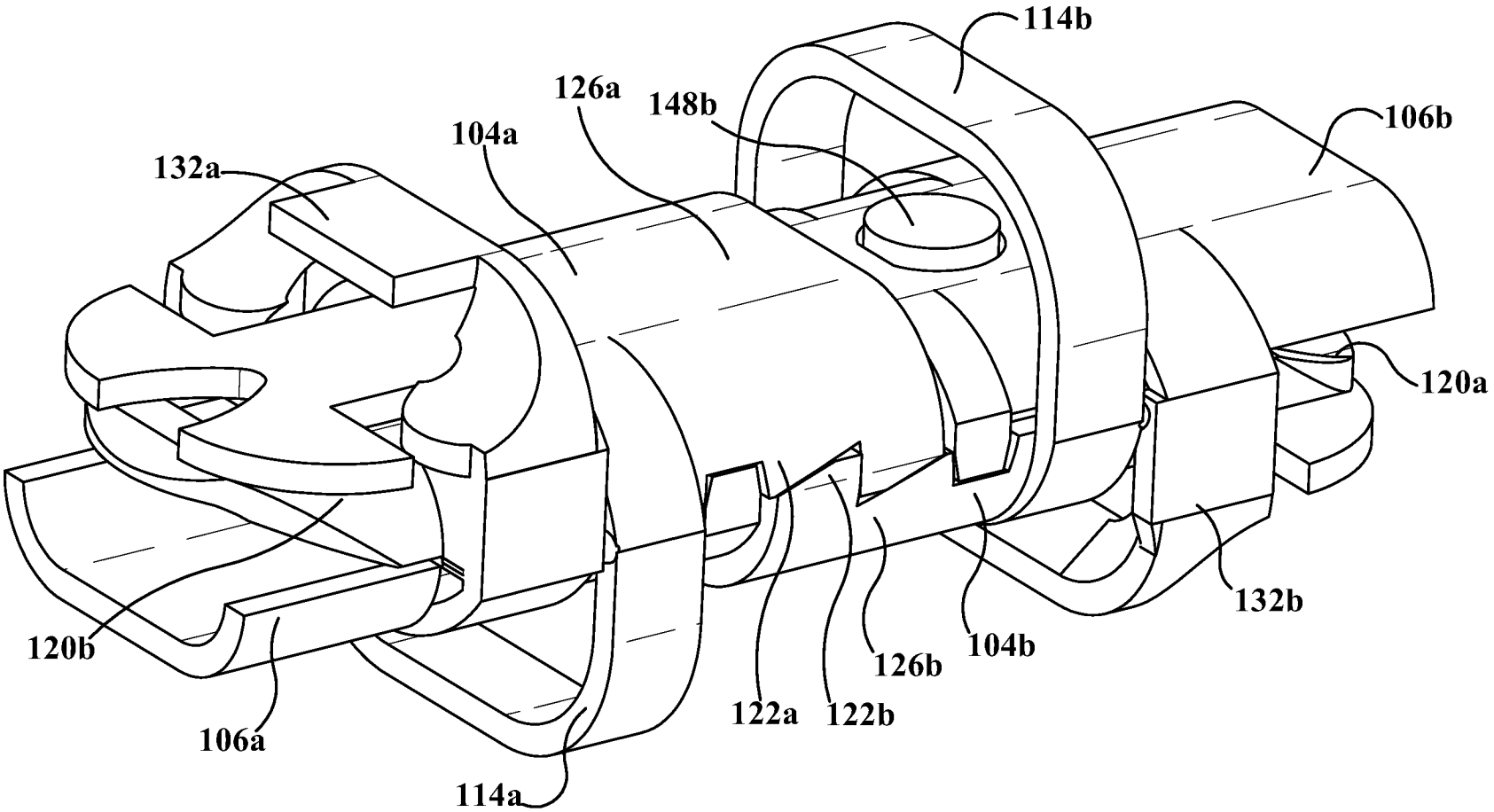
FIG. 10 is a perspective view of the two hermaphroditic connectors in the fully engaged state.

FIG. 9 is a side view of the two hermaphroditic connectors 102*a* and 102*b* in the fully engaged state. FIG. 10 is a perspective view of the two hermaphroditic connectors 102*a* and 102*b* in the fully engaged state. Although connectors 102*a* and 102*b* will typically terminate respective two data cables having a pair of conductors that are electrically connected to the rear tips 150 of tines 108 via the rear of each connector, cables have been omitted from the figures for clarity. When the two connectors 102*a* and 102*b* are brought together, the elongated inner half-shell segment 120 of each connector 102*a* and 102*b* passes through the tunnel 302 (see, e.g., FIGS. 3, 6*a*) formed by the outer half-shell segment 126 and inner half-shell segment 120 of the opposite connector 102. That is, inner half-shell segment 120*a* of connector 102*a* passes through the tunnel 302 formed by outer half-shell segment 126*b* and inner half-shell segment 120*b* of connector 102*b*, while inner half-shell segment 120*b* of connector 102*b* passes through the tunnel 302 formed by outer half-shell segment 126*a* and inner half-shell segment 120*a* of connector 102*a*.

When the connectors 102*a* and 102*b* are brought together to the fully engaged positions, latching teeth 122*a* and 122*b* of the respective outer shell components 104*a* and 104*b* overlap and engage with one another to hold the two connectors 102*a* and 102*b* together in the fully engaged position. As the two connectors 102*a* and 102*b* are brought together, interaction between the inclined edges of the latching teeth 122*a* and 122*b* cause the outer shell components 104*a* and 104*b* to translate away from their corresponding inner shell components 106*a* and 106*b* to allow the latching teeth 122*a* and 122*b* to overlap. When the connectors 102*a* and 102*b* are further pushed together to the fully engaged position, the spring-loaded pressure applied to the outer shell components 104*a* and 104*b* causes the outer shell components 104*a* and 104*b* to return to their default position, thereby locking the latching teeth 122*a* and 122*b* together. This engagement between latching teeth 122*a* and 122*b* serves to hold the connectors 102*a* and 102*b* together while also providing strain relief for the electrically connected tines 108 (not shown in FIGS. 9 and 10) enclosed within the mated connector housings.

While engaged, the overlapping inner half-shell segments 120*a* and 120*b* of the two connectors 102*a* and 102*b* come together to form a complete inner shell that encloses the tine assembly 118, including the contacting segments of tines 108. In the illustrated example, the amount of overlap between the two, engaged connectors 102*a* and 102*b* encompasses nearly the entire lengths of the connectors 102*a* and 102*b*. This relatively long length of the overlap between the inner half-shell segments 120*a* and 120*b* of the respective connectors 102*a* and 102*b* yields a rigid shell that provides resistance to bending and to non-longitudinal cable forces (e.g., pull forces applied to the cables at an angle relative to the axis of the connectors 102*a* and 102*b*).

To disengage the connectors 102*a* and 102*b* from one another, pressure can be applied to one or both of the release bars 114*a* or 114*b*, displacing the corresponding outer shell component 104*a* or 104*b* away from its corresponding inner shell component 106*a* or 106*b*, thereby disengaging the latching teeth 122*a* and 122*b* and allowing the connectors 102*a* and 102*b* to be unplugged from one another. To provide leverage when applying pressure to the release bars 114*a* or 114*b*, the user can place a finger or thumb on loop structure 132*a* or 132*b* while applying pressure to the release bar 114*a* or 114*b* using another finger or thumb, allowing the connectors 102*a* and 102*b* to be disengaged using a squeezing action between a thumb and finger.

The curved design of the tines 108 and their behavior when two connectors 102*a* and 102*b* are plugged together yield benefits in terms of contact redundancy, high-frequency signal integrity, and mitigation of connector performance degradation due to arc erosion. In general, the electrical connection between two contacts or tines of respective two mated connectors can be rendered more reliable if the two contacts touch one another at multiple contact points. If vibration or other environmental factors cause one of these multiple contact points to temporarily separate and lose connectivity, one or more of the other redundant contact points may maintain contact, thereby preserving the electrical connection without interruption. Contact redundancy is sometimes realized using parallel bifurcated contacts, as found in forked contacts in which each of two parallel prongs of the contact achieves independent contact with the surface of a mating contact. However, such bifurcated redundant contacts may require connector housings of additional width to contain the laterally spaced redundant contacts, increasing the size of the connector's footprint.

By contrast, tines 108 are designed to form a connection having multiple redundant in-line contact points disposed along the lengths of the tines. FIGS. 11*a*-11*d* are side views of two tine assemblies 118*a* and 118*b* illustrating the deformations and interactions of the interfacing tines 108 as the two connectors 102*a* and 102*b* are plugged together. To clearly depict the interactions between the tines 108*a* and 108*b*, the outer shell components 104*a* and 104*b* and inner shell components 106*a* and 106*b* are omitted from FIGS. 11*a*-11*d* so that only the tine assemblies 118*a* and 118*b* are shown. FIGS. 11*a*-11*d* respectively depict four sequential stages as the two connectors 102 progress from fully separated (FIG. 11*a*) to fully engaged (FIG. 11*d*).

Figure 11A:
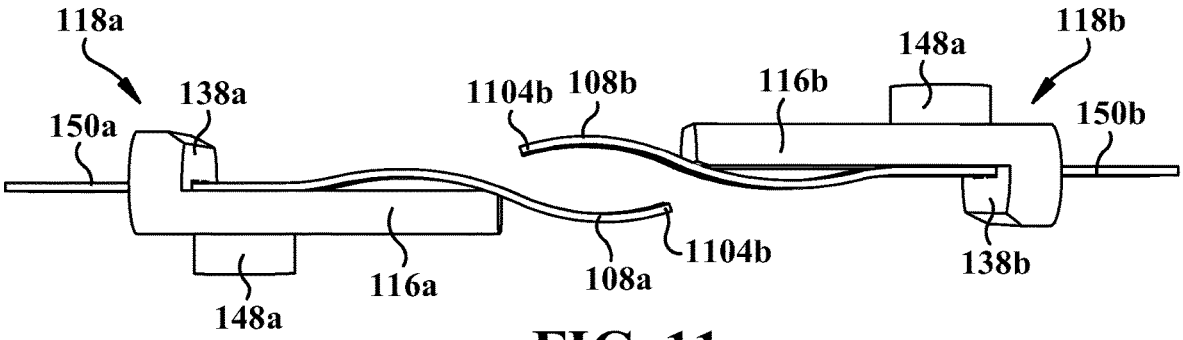
FIGS. 11*a*-11*d* are side views of two tine assemblies illustrating the deformations and interactions of the interfacing tines as the two connectors are plugged together.
Figure 11B:
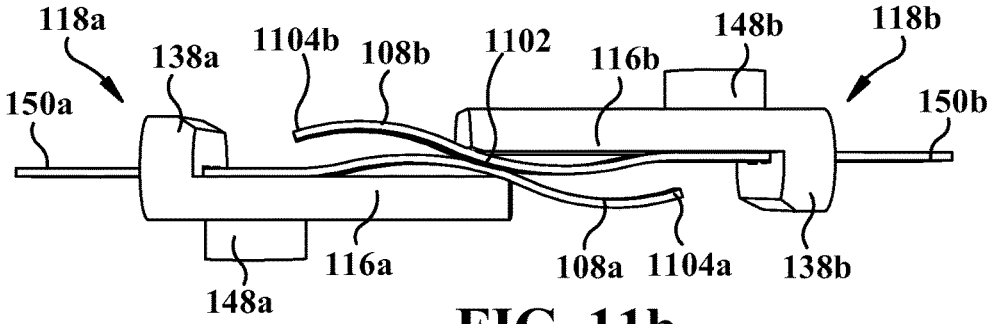
Figure 11C:
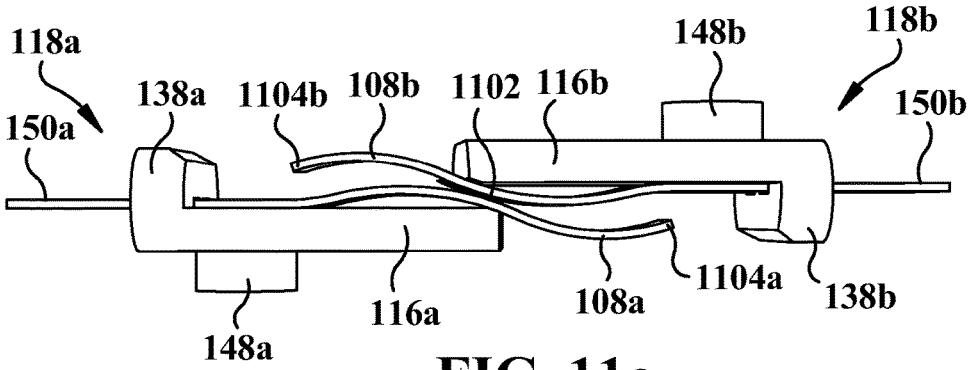
Figure 11D:
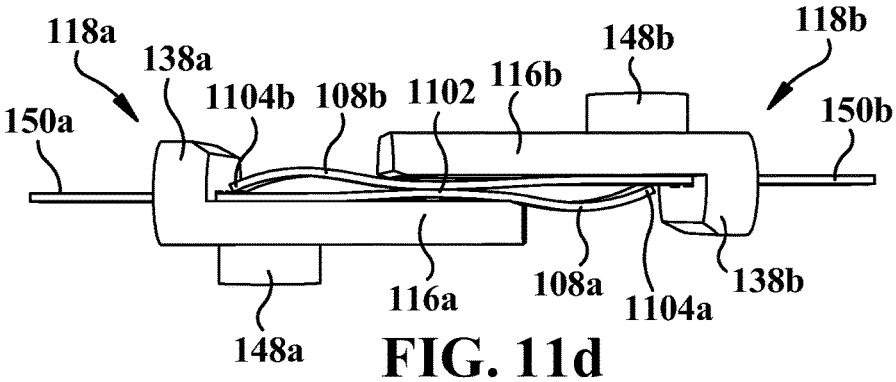

FIG. 11*a* depicts tine assemblies 118*a* and 118*b* when the two connectors 102*a* and 102*b* are initially separated but aligned for engagement with one another. At this stage there is no contact between tines 108*a* and 108*b*, which remain in their default shapes while the connectors 102*a* and 102*b* are disengaged. As the connectors 102*a* and 102*b* are brought together, tines 108*a* and 108*b* make initial contact at point 1102, as shown in FIG. 11*b*. Point 1102 resides along the middle front-facing slopes of the tines' curved profiles, which face each other when the connectors 102*a* and 102*b* are aligned for engagement. As shown in FIG. 11*c*, as the connectors 102*a* and 102*b* continue to be pushed together after initial contact at point 1102, pressure applied to the tines 108*a* and 108*b* by tine support plates 116*a* and 116*b* and by each other cause the tines 108*a* and 108*b* to deform to a more flattened state, causing each of the tips 1104*a* and 1104*b* of the tines 108*a* and 108*b* to swing toward its opposing tine. During this transition, contact between the tines 108*a* and 108*b* at or near point 1102 is maintained (though this point of contact may shift slightly during the transition to the fully engaged state). When the connectors 102*a* and 102*b* are fully engaged, as shown in FIG. 11*d*, each of the tips 1104*a* and 1104*b* are in contact with its opposing tine, with contact at point 1102 also maintained. This yields three in-line points of contact between each pair of connected tines 108—a first point of contact between tine 108*a* and the tip 1104*b* of tine 108*b*, a second point of contact between tine 108*b* and the tip 1104*a* of tine 108*a*, and a third point of contact at point 1102 between the first and second points of contact.

These multiple in-line contact points provide contact redundancy, which improves reliability of the electrical connection relative to electrical contacts that connect at only a single point. This contact point redundancy can be particularly beneficial in high vibration environments, which elevate the risk of a momentary disconnect at one or more contact points. The three redundant contact points occur along the profiles of the tines 108*a* and 108*b*, and therefore consume less width relative to bifurcated redundant contact points.

The design and behavior of tines 108 can also mitigate deterioration of connectivity reliability due to arc erosion pitting when the connectors 102 are used in Power over Ethernet (PoE) applications. Power over Ethernet systems deliver power to end devices via ethernet cabling. Typically, PoE power supplies only apply power to the ethernet cable conductors after a device has been plugged into the cable's terminating connector. When a PoE power supply detects that a device has been connected to the network cabling, the power supply may identify the power specifications of the device, set the output current and/or voltage of the PoE power accordingly, and begin delivering power to the device via the ethernet cabling and associated connector. According to this sequence, power is not initially present on the conductive tines when a first connector associated with the device is plugged into a second connector that terminates the ethernet cable. However, since power is present on the tines when the connectors are unplugged from one another, inductive elements in the conductive channels can cause an electrical arc to discharge at the point of final disconnection between the two conductive tines at the moment when the connectors are disconnected. Over time, this repeated electrical arcing at or near the same locations on the two tines can damage the tines' surfaces at the point of disconnect, eroding the conductive surfaces of the tines. In many connector systems (e.g., RJ-45 connectors and jacks, or other types of connector systems), the point of disconnect between two electrical contacts or tines is at or near the sole point of contact when the connectors are fully plugged in. Consequently, pitting damage incurred at this point due to repeated arcing can degrade the reliability of the electrical connection between the two tines or contacts.

The tine design depicted in FIGS. 11*a*-11*d* can prevent this arc erosion from compromising the integrity of the electrical connection between the two tines 108*a* and 108*b*. As illustrated in FIG. 11*d*, tines 108*a* and 108*b* connect at three contact points when the two connectors 102*a* and 102*b* are fully engaged—at tip 1104*a*, tip 1104*b*, and point 1102. If the connectors 102*a* and 102*b* are being used in a PoE application, power may be present on the tines 108*a* and 108*b* while connected. When the connectors 102*a* and 102*b* are disconnected, the tines 108*a* and 108*b* disengage from one another in a sequence that is reversed from the engagement sequence. This disengagement sequence is illustrated by reversing the progression of FIGS. 11*a*-11*d* (that is, by sequencing backward from FIG. 11*d* to FIG. 11*a*). By following this reverse sequence, it can be seen that tine tips 1104*a* and 1104*b* disconnect (at FIG. 11*c*) prior to disconnection of contact point 1102 (at FIG. 11*a*). Thus, contact point 1102 will always be the last of the three redundant contact points to disconnect, and consequently will be the only one of the three contact points to sustain pitting due to arc erosion, since the last point on the tines to disengage will be the only point that experiences arcing. This leaves the redundant contact points at tine tips 1104*a* and 1104*b* unaffected by arc erosion, ensuring that at least two redundant contact points remain free of arc-related damage.

Moreover, the design of tines 108 can promote integrity of high frequency signals by emulating a flat stripline while the connectors 102*a* and 102*b* are engaged. The contact tips of typical male-female connectors often comprise lead-in shapes—such as highly curved ski-tips or bell-shaped ends—that are sufficiently curved to facilitate smooth and reliable mating with the opposing contact when the two connectors are plugged together. These highly curved lead-in contact shapes are typically maintained while the two connectors are fully engaged, resulting in appendages or stubs along the transmission path that may act as resonant entities that disturb the characteristic impedance and compromise signal integrity by creating signal reflections, particularly in high-frequency signal applications that support high data capacity. Consequently, designers must often seek a compromise between providing a sufficiently curved contact tip shape that ensures a smooth lead-in as the connectors are plugged together and minimizing contact discontinuities that may serve as resonant entities that degrade high-frequency signal integrity. Ideally, the mated contacts should be as flat as possible—that is, should emulate a flat stripline to the degree possible—while plugged together in order to minimize disturbances to characteristic impedance, cross-talk, stray reflections, and other behaviors detrimental to high-frequency signals.

The tine design depicted in FIGS. 11*a*-11*d* can satisfy smooth lead-in requirements while also maintaining high-frequency signal integrity by dynamically morphing the tine shapes as the connectors 102*a* and 102*b* are plugged together. As shown in FIG. 11*a*, while the connectors are unplugged, tines 108*a* and 108*b* have a default relaxed shape corresponding to a first profile that is sufficiently curved to ensure a smooth lead-in and reliable connectivity between the tines 108*a* and 108*b*. As the connectors 102*a* and 102*b* transition to the fully engaged state, tines 108*a* and 108*b* are pressed into a more flattened shape between support plates 116*a* and 116*b*, which overlap one another when the connectors 102*a* and 102*b* are fully engaged and press the tines 108*a* and 108*b* therebetween. As a result, the shapes of the tines 108*a* and 108*b* while the connectors 102*a* and 102*b* are fully engaged (illustrated in FIG. 11*d*) conform to a second profile that is substantially flattened relative to the first profile while fully disengaged (illustrated in FIG. 11*a*). This more flattened second profile more closely resembles a stripline that is more conducive to undisturbed high-frequency signal transmission. Consequently, in embodiments in which the inner shell component 106 is metal or metal-plated, pairs of mated tines 108 together with the metal shielding provided by the inner shell components 106*a* and 106*b* emulate an edge-coupled stripline that provides a high level of signal integrity in high-frequency, high data capacity applications.

Figure 12A:
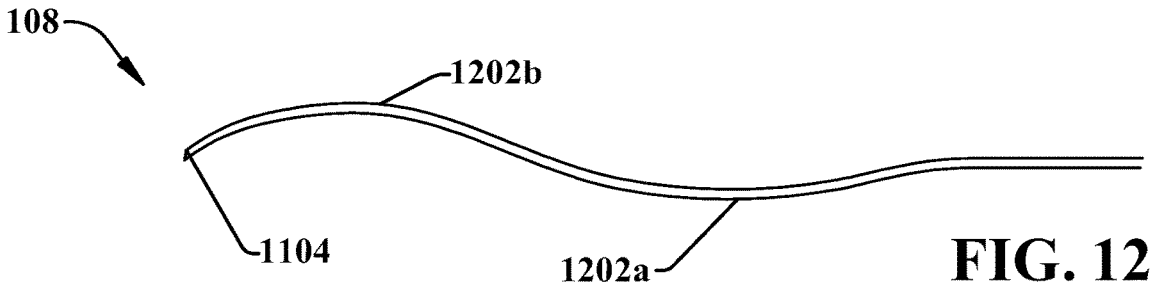
FIGS. 12*a*-12*c* are side views of example curved profiles to which tines can conform in various embodiments of the hermaphroditic connector.
Figure 12B:
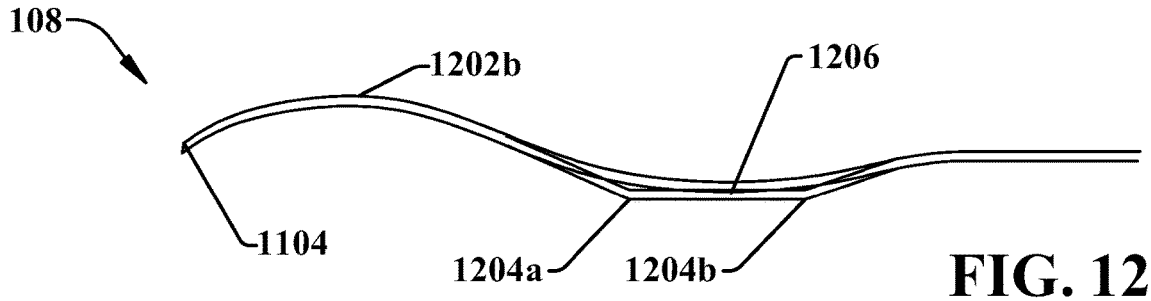
Figure 12C:
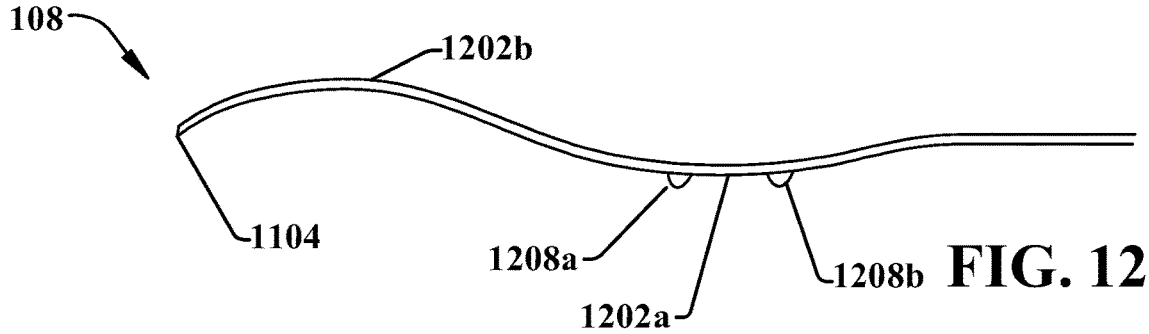

Although the illustrated examples depict tines 108 as having continuously curved profiles, in some embodiments the curved profile of each tine 108 may include one or more abrupt discontinuities along the profile, including angles, bumps, or acute points. The addition of such discontinuities to the tine profiles may increase both the number of redundant contact points as well as the relative pressure-independence of each redundant contact point while the connectors 102*a* and 102*b* are engaged. FIGS. 12*a*-12*c* are side views of example curved profiles to which tines 108 can conform in various embodiments of connector 102.

FIG. 12*a* illustrates the continuously curved profile (without discontinuities) depicted in the previous illustrated examples. This profile comprises a lower curve 1202*a* (generally corresponding to contact point 1102) that segues to an upper curve 1202*b*, which terminates in tip 1104.

FIG. 12*b* illustrates an example tine profile in which the upper curve 1202*b* is maintained, but lower curve 1202*a* is replaced by a flattened section 1206 defined by two corners 1204*a* and 1204*b* bent at obtuse angles. When flattened against a similar inverted tine 108 of a mating connector 102 between two support plates 116 (as depicted in FIG. 11*d* for the continuously curved profile), the flattened section 1206 may arch, causing the two corners 1204*a* and 1204*b* to form respective two contact points with the other tine, thereby yielding a connection with four in-line contact points (corners 1204*a* and 1204*b* and tine tips 1104*a* and 1104*b* of each of the two tines) between the two tines 108, rather than three contact points as in the case of the continuously curved profile.

FIG. 12*c* illustrates an example tine profile in which two downward-facing bumps 1208*a* and 1208*b* are formed along the lower curve 1202*a*. Similar to the profile illustrated in FIG. 12*b*, each bump 1208*a* and 1208*b* can form an individual contact point with the opposing tine, yielding a total of four contact points between two interfacing tines 108.

Figure 13:
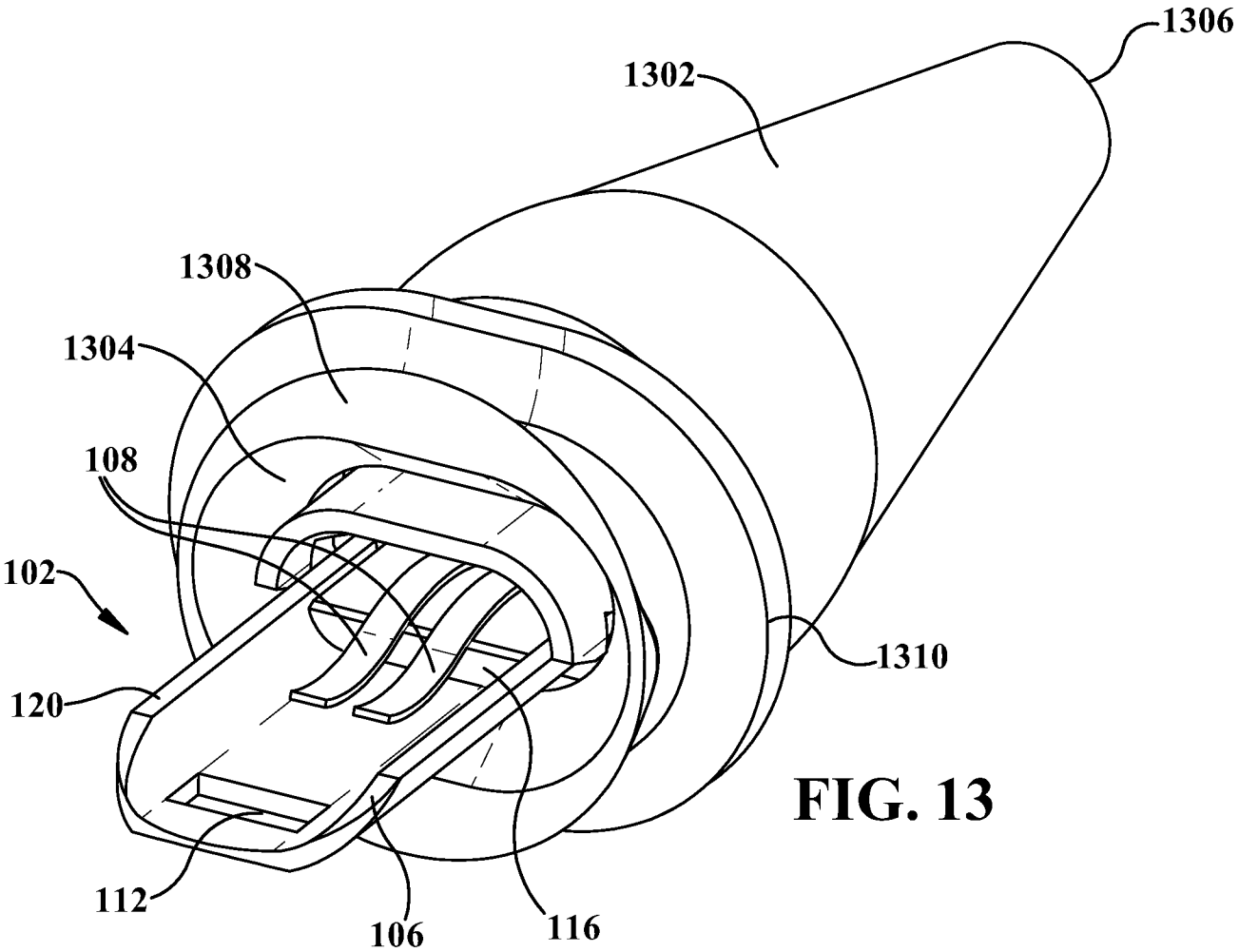
FIG. 13 is a front perspective view of an example hermaphroditic connector encased in an example boot.
Figure 14:
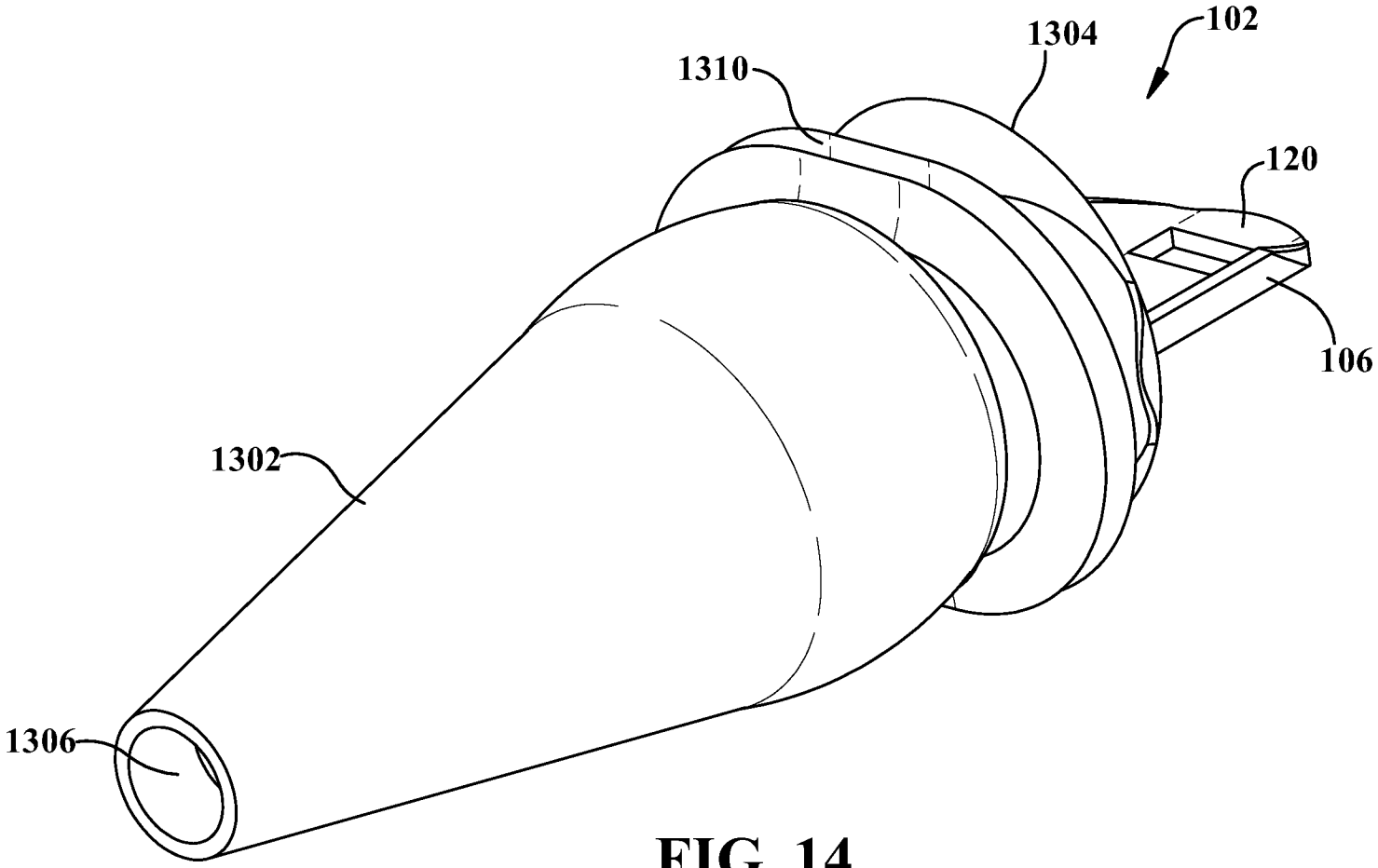
FIG. 14 is a rear perspective view of the example hermaphroditic connector encased in the example boot.
Figure 15:
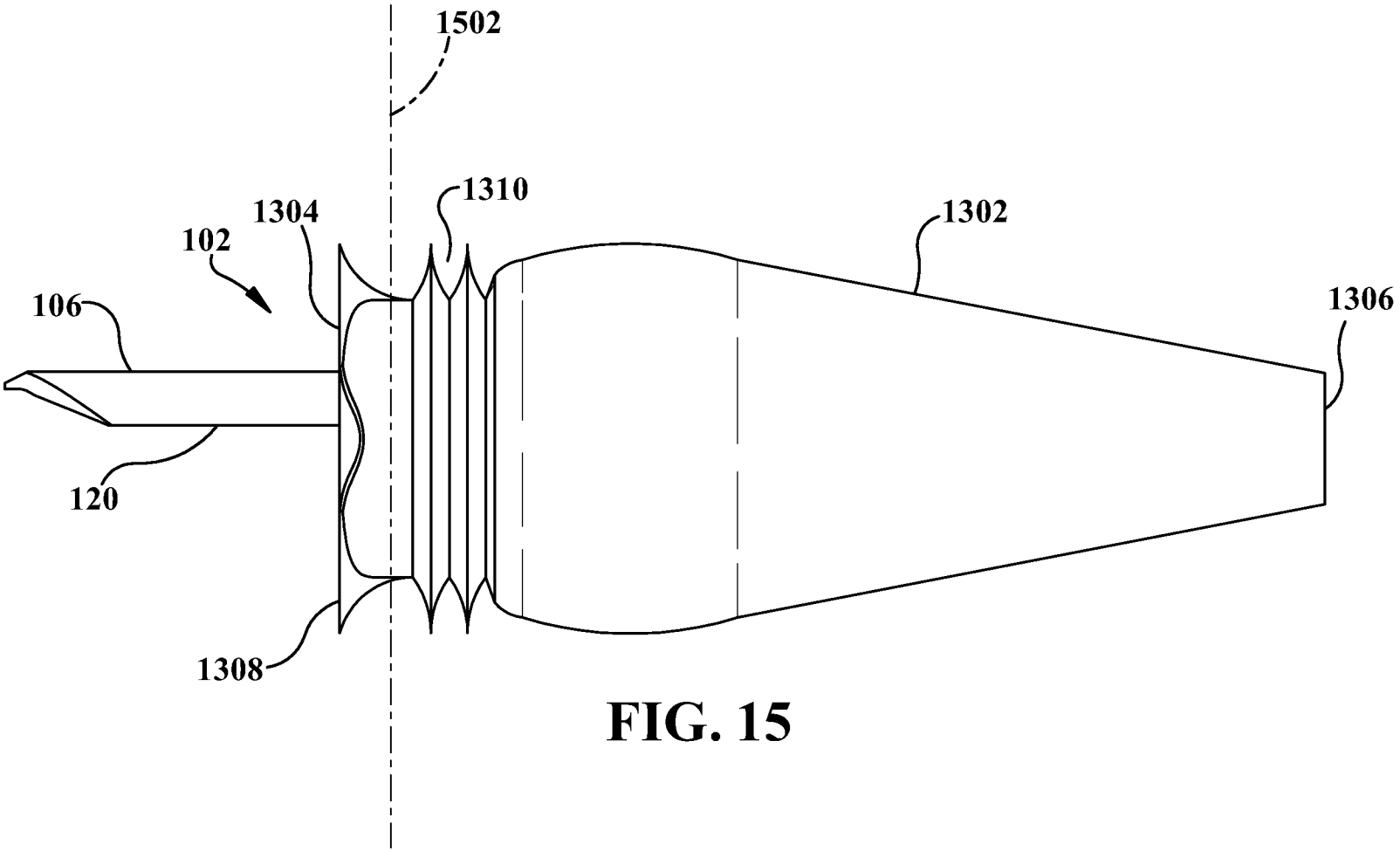
FIG. 15 is a side view of the example hermaphroditic connector encased in the example boot.
Figure 16:
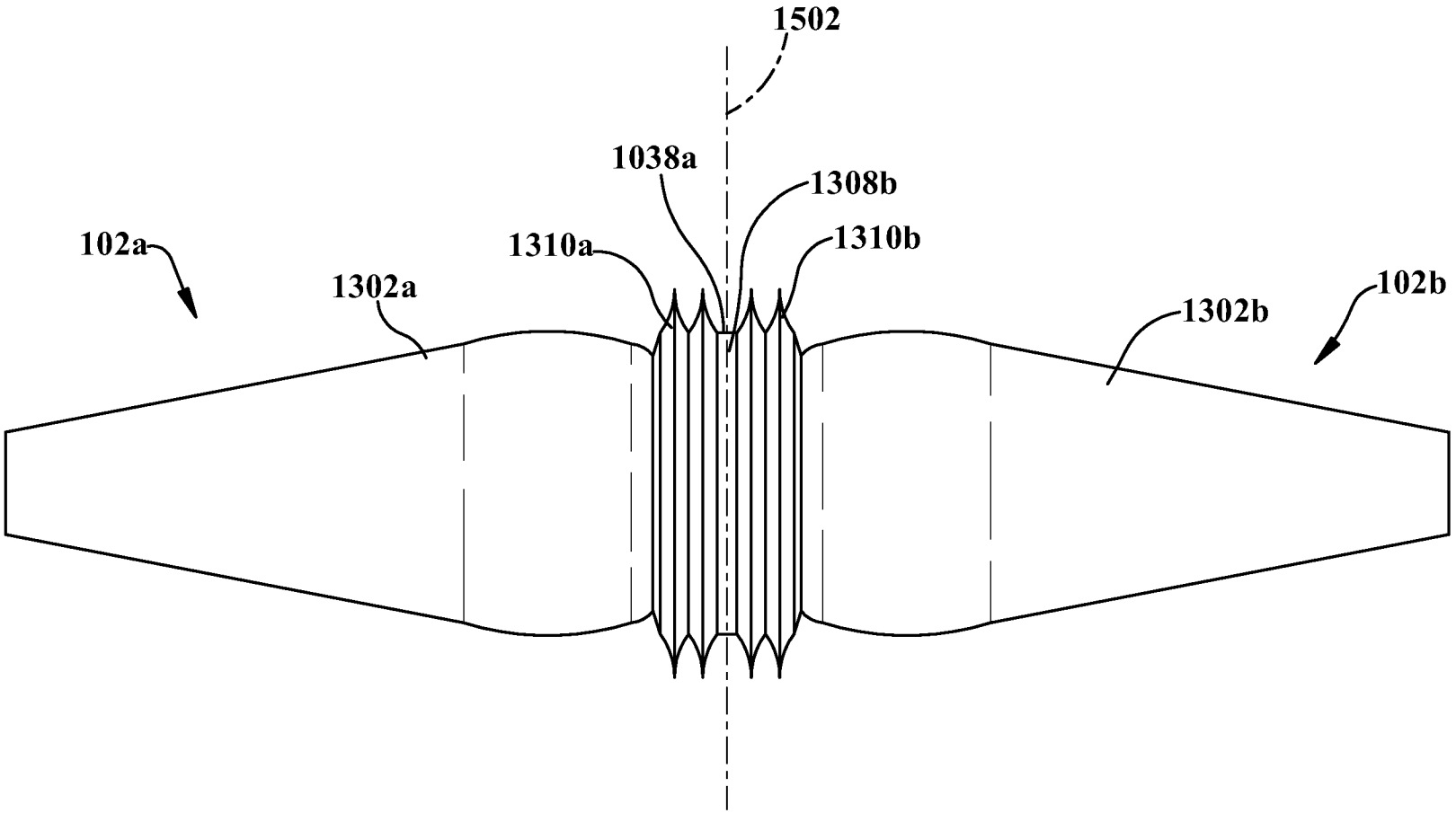
FIG. 16 is a side view illustrating two engaged hermaphroditic connectors encased in respective boots.

In some embodiments, hermaphroditic connector 102 can be encased in a soft, flexible boot that provides further protection as well as water-resistance. FIG. 13 is a front perspective view of hermaphroditic connector 102 encased in an example boot 1302. FIG. 14 is a rear perspective view of the connector 102 encased in the boot 1302. FIG. 15 is a side view of connector 102 encased in boot 1302. Boot 1302 can be made of a flexible, water-proof material, including but not limited to rubber or flexible plastic. When boot 1302 is installed over connector 102, the front portion of the connector's inner half-shell segment 120 protrudes through a front opening 1304 at the front end of the boot 1302. Behind the front opening 1304 is an accordion-style collapsible section 1310 that makes up the front end of the boot 1302. The rim 1308 of front opening 1304 comprises a flat surface configured to form a seal with a corresponding rim 1308 of a second boot 1302 when the connector 102 is engaged with a similar second connector. While the connector 102 is unmated and the collapsible section 1310 is in its default non-compressed state, the rim 1308 is located beyond the mating centerline 1502 (see FIGS. 15 and 16) toward the front end of the connector 102. Consequently, when the connector 102 is mated with another connector 102 having a similar boot 1302, the rims 1308 of the respective boots 1302 will make contact and the collapsible sections 1310 will compress. A rear opening 1306 is formed at the rear end of the boot 1302 for entry of a cable (e.g., an ethernet cable) whose conductors can be terminated on the rear tips 150 of tines 108 (not visible in FIGS. 13-15). Rear opening 1306 can be sized to form a tight waterproof seal around the cable FIG. 16 is a side view illustrating two engaged hermaphroditic connectors 102*a* and 102*b* encased in respective boots 1302*a* and 1302*b*. When the two connectors 102*a* and 102*b* are mated, the flat rims 1308*a* and 1308*b* surrounding the front openings of the respective two boots 1302*a* and 1302*b* press together to form a waterproof seal, and the connector insertion force causes the two collapsible sections 1310*a* and 1310*b* of the respective two boots 1302*a* and 1302*b* to compress. While the connectors 102*a* and 102*b* are mated, the lateral pressure exerted by the collapsible sections 1310*a* and 1310*b* while in their compressed states (that is, the pressure directed toward the front of the connectors 102*a* and 102*b* by their respective collapsible sections 1310*a* and 1310*b* as they seek to return to their default extended state) maintain a reliable waterproof seal (e.g., an IP65 or IP67 rated seal) between the two flat rims 1308*a* and 1308*b*. In this way, collapsible sections 1310*a* and 1310*b* behave as compression springs that maintain sealing pressure on the flat rims 1308*a* and 1308*b* to ensure a reliable seal between the two boots 1302*a* and 1302*b*. This boot design, assisted by the small size of the connector 102 which provides a higher sealing pressure density, mitigates the need for a large and complicated pressure creation apparatus to maintain a reliable waterproof seal. While mated, the two connectors 102*a* and 102*b* are fully encompassed by boots 1302*a* and 1302*b*, providing protection against physical damage and supplementing the protection afforded by the inner and outer shells of the connectors 102*a* and 102*b*.

Since boots 1302*a* and 1302*b* are made of a flexible material, the mated connectors 102*a* and 102*b* can be disengaged from one another while encased in boots 1302*a* and 1302*b* by applying pressure to one or both of the release bars 114 through the boots 1302*a* and 1302*b*. In some embodiments, boot 1302 can apply sufficient pressure to outer shell component 104 to hold the outer shell component 104 in place on the inner shell component 106 without the use of a compression spring. In such embodiments, the flexibility of boot 1302 allows the outer shell component 104 to be displaced in response to pressure applied to the release bar 114 to facilitate disengagement of the connector 102, while also forcing the outer shell component 104 back into its default position against inner shell component 106 when pressure is removed from the release bar 114.

Figure 17:
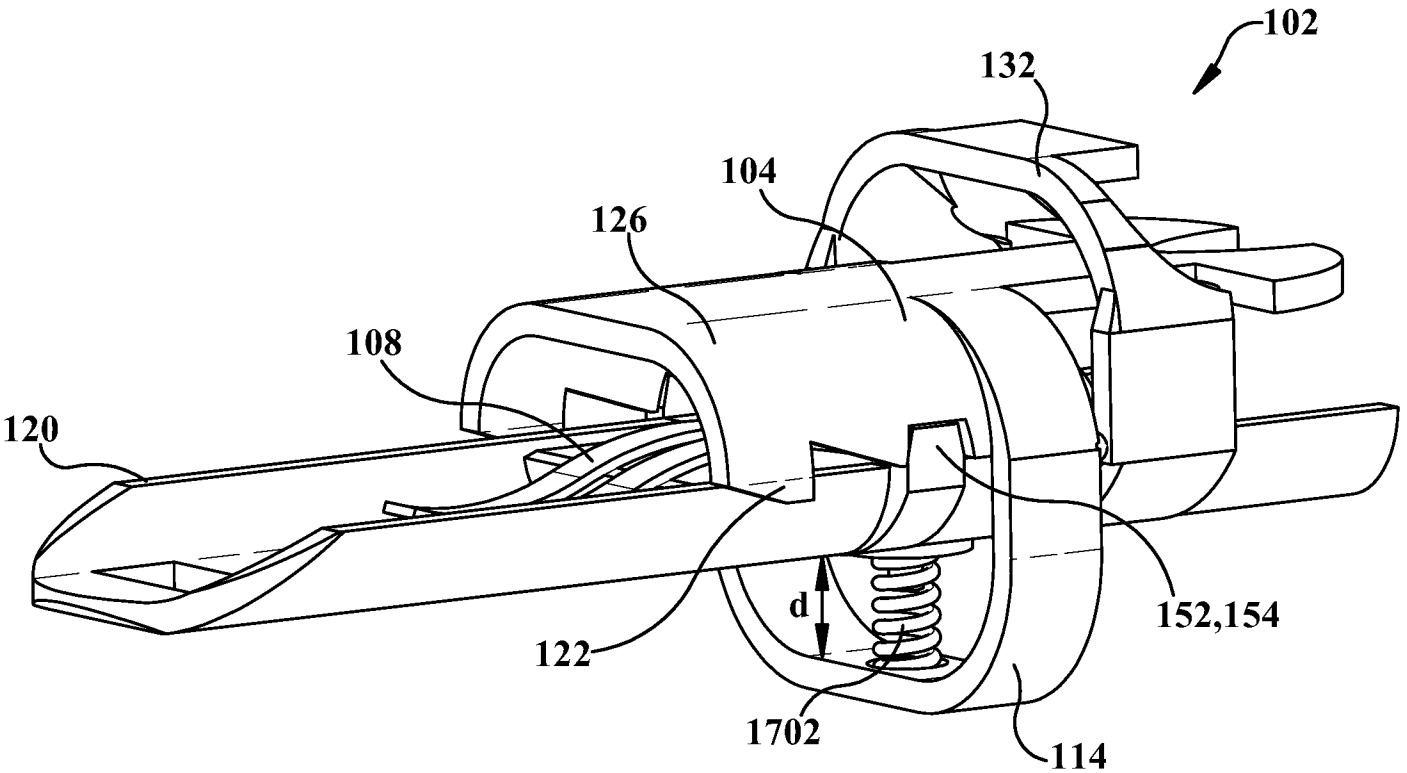
FIG. 17 is a perspective view of a connector when a compression spring is used to hold the outer shell component in place on the inner shell component.

FIG. 17 is a perspective view of connector 102 when a compression spring 1702 is used to hold the outer shell component 104 in place on the inner shell component 106. Compression spring 1702 can be used as an alternative to, or in addition to, boot 1302 as a means for flexibly holding the outer shell component 104 in place on the inner shell component 106 while still allowing the outer shell component 104 to be displaced in response to pressure applied to the release bar 114, allowing the connector 102 to be disengaged from a mating connector. In this example embodiment, one end of compression spring 1702 is connected to the inner surface of the release bar 114 and the other end of compression spring 1702 is connected to the bottom of inner shell component 106. The uncompressed length of compression spring 1702 is greater than the distance d between the release bar 114 and the inner shell component 106, causing the compression spring 1702 to be compressed while connected between the outer shell component 104 and the inner shell component. The force applied by the compression spring 1702 while in this compressed state holds outer shell component 104 in place against inner shell component 106, while allowing displacement of the outer shell component 104 when pressure is applied to the release bar 114.

Figure 18A:
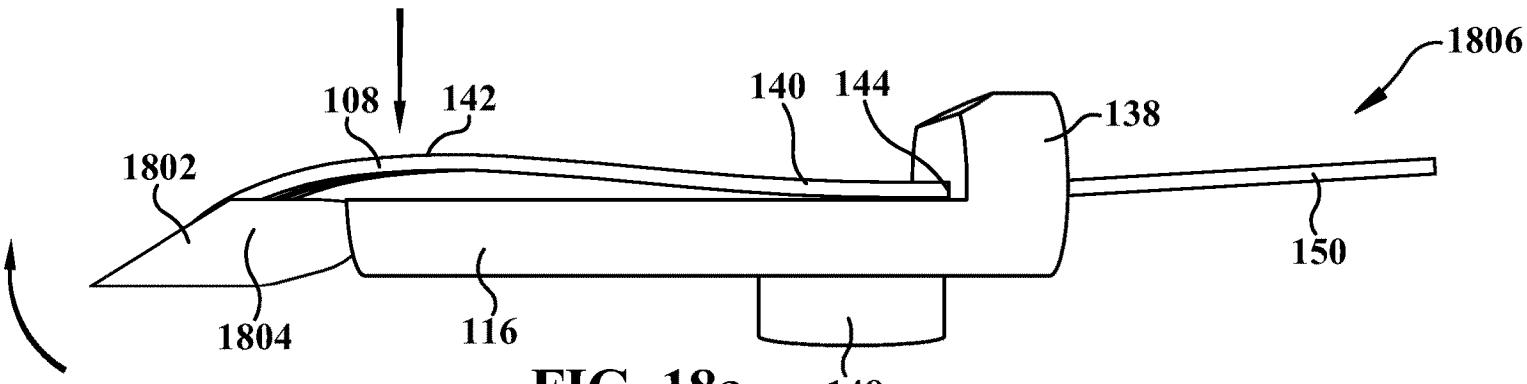
FIG. 18*a* is a side view of an alternative embodiment of the tine assembly.
Figure 18B:
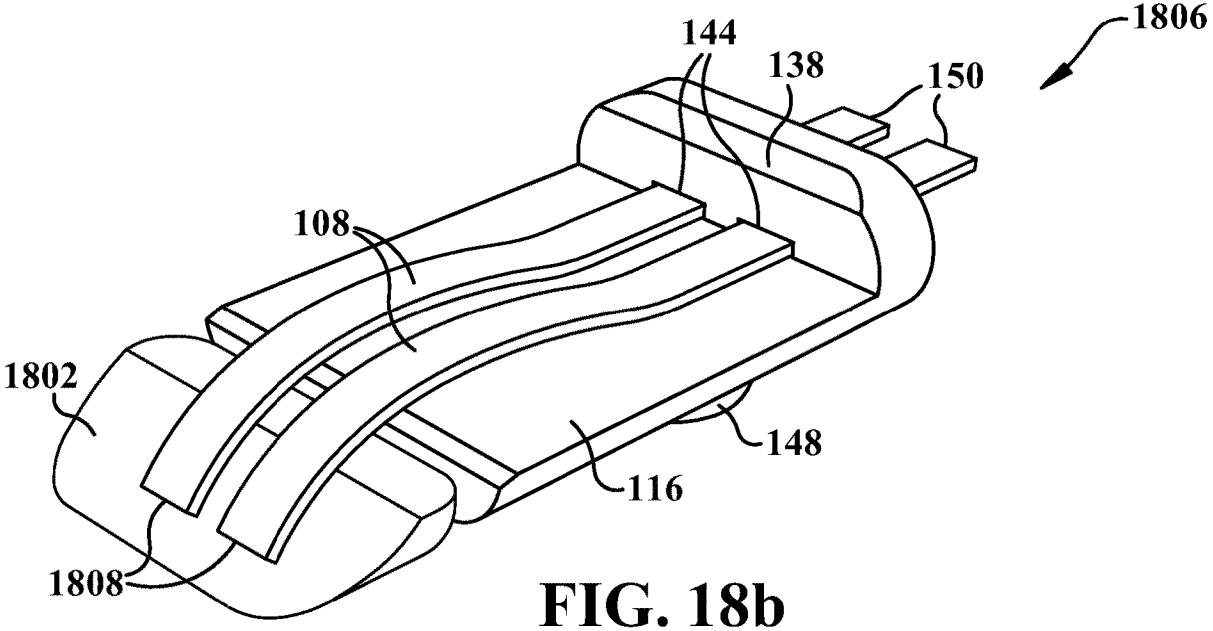
FIG. 18*b* is a perspective view of the alternative embodiment of the tine assembly.

FIG. 18*a* is a side view of an alternative embodiment of the tine assembly 1806. FIG. 18*b* is a front perspective view of this alternative embodiment of the tine assembly 1806. In this example, tines 108 have a simpler curved profile relative to that depicted in FIG. 1, whereby the upward curve near the tip of the tine 108 is omitted or greatly reduced, yielding a tip that curves downward. These downward-facing tips of tines 108 rest within substantially parallel grooves 1808 of a pivoting dielectric nose plate 1802 adjacent to the front end of support plate 116. Nose plate 1802 is configured to pivot about point 1804. When a connector 102 comprising tine assembly 1806 is connected to a similar connector (using the connection technique depicted in FIGS. 11*a*-11*d*), tines 108 are substantially flattened as a result of pressure applied near point 142 by the mating tines of the mating connector. This flattening causes the tips of tines 108 to raise, guided by the upward pivoting of nose plate 1802 about point 1804 (as indicated by the curved arrow). This embodiment of tine assembly 1806 can yield a flatter tine profile while the connectors are engaged relative to previously described examples. In some embodiments, the tips of tines 108 depicted in FIGS. 18*a* and 18*b* can include small dimples or protrusions in order to maintain the three in-line redundant contact points. The curved profile depicted in FIGS. 18*a* and 18*b* can also be modified by adding discontinuities along the curved profile similar to those illustrated in FIGS. 12*b* and 12*c* (e.g., corners, bumps, points, etc.) to yield additional in-line redundant contact points between the tine and a mating tine.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

What has been described above includes examples of systems and methods illustrative of the disclosed subject matter. It is, of course, not possible to describe every combination of components or methodologies here. One of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

What is claimed is:

1. A hermaphroditic connector, comprising:

an inner shell component comprising an elongated inner half-shell segment;

an outer shell component held to the inner shell component by a spring force, wherein the outer shell component comprises an outer half-shell segment comprising two or more downward-facing edges, and one or more latching teeth are formed on the two or more downward-facing edges;

a first tine support plate mounted to the inner shell component; and one or more first tines that rest on the first tine support plate, the one or more first tines having a first curved profile while the hermaphroditic connector and a second connector are unmated, wherein while the hermaphroditic connector and the second connector are mated, the one or more first tines electrically connect with one or more second tines of the second connector, and the one or more first tines and the one or more second tines are pressed together between the first tine support plate and a second tine support plate of the second connector causing the one or more first tines to deform to a second curved profile that is flattened relative to the first curved profile.

2. The hermaphroditic connector of claim 1, wherein the second connector is a second hermaphroditic connector, the one or more latching teeth are configured to engage with one or more second latching teeth of the second hermaphroditic connector while the hermaphroditic connector is mated with the second hermaphroditic connector, and engagement of the one or more latching teeth with the one or more second latching teeth hold the hermaphroditic connector and the second hermaphroditic connector in a connected state.

3. The hermaphroditic connector of claim 2, wherein the outer shell component further comprises a release bar, and application of pressure on the release bar causes the outer shell component to displace from the first inner shell component against the spring force and to disengage the one or more latching teeth from the one or more second latching teeth.

4. The hermaphroditic connector of claim 2, wherein while the hermaphroditic connector and the second hermaphroditic connector are mated, the elongated inner half-shell segment and a second elongated inner half-shell segment of the second hermaphroditic connector form an inner shell that surrounds the first tine support plate and the second tine support plate.

5. The hermaphroditic connector of claim 2, wherein while the hermaphroditic connector and the second hermaphroditic connector are mated, a first tine of the one or more first tines electrically connects with a second tine of the one or more second tines at three or more contact points along a length of the first tine.

6. The hermaphroditic connector of claim 5, wherein the three or more contact points comprise a first contact point at which a first tip of the first tine makes contact with the second tine, a second contact point at which a second tip of the second tine makes contact with the first tine, and a third contact point between the first contact point and the second contact point.

7. The hermaphroditic connector of claim 6, wherein as the hermaphroditic connector and the second hermaphroditic connector are disengaged, the third contact point is a last contact point, of the three or more contact points, at which the first tine electrically disconnects from the second tine.

8. The hermaphroditic connector of claim 2, further comprising a boot that fits over the hermaphroditic connector, wherein the boot comprises a front opening having a flattened rim configured to form a seal with a second flattened rim of a second boot that fits over the second hermaphroditic connector.

9. The hermaphroditic connector of claim 8, wherein a front end of the boot comprises a collapsible section on which the front opening is formed, and while the hermaphroditic connector is mated with the second hermaphroditic connector, the collapsible section is compressed and applies pressure that presses the flattened rim against the second flattened rim.

10. The hermaphroditic connector of claim 1, wherein a tine, of the one or more first tines, comprises one or more discontinuities along a curved profile of the tine, and the one or more discontinuities comprise at least one of a bend, a bump, or a point.

11. The hermaphroditic connector of claim 1, wherein the spring force is applied by at least one of a compression spring that holds the outer shell component against the inner shell component or a flexible boot that surrounds the hermaphroditic connector.

12. A hermaphroditic connector, comprising:

a first tine support plate attached to an inner half-shell segment of an inner shell component;

one or more first electrically conductive tines that at least partially rest on the tine support plate; and an outer shell component attached to the inner shell component by a spring force, wherein the outer shell component comprises an outer half-shell segment comprising two or more downward-facing edges, and one or more latching teeth are formed on the two or more downward-facing edges, the one or more first electrically conductive tines have a first curved profile, while the hermaphroditic connector is engaged with a second connector, the one or more first electrically conductive tines are deformed to a second curved profile in response to pressure applied by the first tine support plate and a second tine support plate of the second connector, and the second curved profile is flattened relative to the first curved profile.

13. The hermaphroditic connector of claim 12, wherein the outer half-shell segment forms a tunnel with the inner half-shell segment of the inner shell component, and the first tine support plate at least partially resides within the tunnel.

14. The hermaphroditic connector of claim 13, wherein the second connector is a second hermaphroditic connector, and the one or more latching teeth are configured to engage with one or more other latching teeth of the second hermaphroditic connector while the hermaphroditic connector is engaged with the second hermaphroditic connector.

15. The hermaphroditic connector of claim 14, wherein the outer shell component comprises a release bar, and in response to pressure applied to the release bar, the outer shell component moves against the spring force away from the inner shell component causing the one or more first latching teeth to disengage from the one or more second latching teeth.

16. The hermaphroditic connector of claim 14, wherein while the hermaphroditic connector is engaged with the second hermaphroditic connector, the inner half-shell segment forms an inner shell with a second inner half-shell segment of the second hermaphroditic connector, the inner shell at least partially surrounding the first tine support plate the second tine support plate.

17. The hermaphroditic connector of claim 14, wherein while the hermaphroditic connector is engaged with the second hermaphroditic connector, a first tine of the one or more first electrically conductive tines makes contact with a second tine of the one or more second electrically conductive tines at three or more contact points along a length of the first tine.

18. A connector system, comprising:

a first hermaphroditic connector configured to engage with a second hermaphroditic connector, wherein the first hermaphroditic connector comprises first conductive tines disposed on a first tine support plate located within the first hermaphroditic connector, the first tine support plate is disposed on a first inner shell component of the first hermaphroditic connector, the first conductive tines have a first curved profile while the first hermaphroditic connector and the second hermaphroditic connector are disengaged, and while the first hermaphroditic connector and the second hermaphroditic connector are engaged, a first tine of the first conductive tines make electrical contact with a second conductive tine disposed on a second tine support plate disposed on a second inner shell component of the second hermaphroditic connector, the first tine making the electrical contact at three or more contact points along a length of the first tine, the first conductive tines and the second conductive tines translate from the first curved profile to a second curved profile in response to pressure applied by the first tine support plate and the second tine support plate while the first hermaphroditic connector and the second hermaphroditic connector are engaged, and the second curved profile is flattened relative to the first curved profile.

19. The connector system of claim 18, wherein the three or more contact points comprise a first contact point at which a first tip of the first tine makes contact with the second tine, a second contact point at which a second tip of the second tine makes contact with the first tine, and a third contact point between the first contact point and the second contact point.

20. The connector system of claim 18, wherein the first hermaphroditic connector further comprises an outer shell component held to the first inner shell component by a spring force, the outer shell component comprising an outer half-shell segment having one or more latching teeth formed on two downward-facing edges of the outer half-shell segment.

* * * * *